US011480894B2

(12) United States Patent
Imaizumi

(10) Patent No.: US 11,480,894 B2
(45) Date of Patent: Oct. 25, 2022

(54) IMAGE FORMING APPARATUS

(71) Applicant: CANON KABUSHIKI KAISHA, Tokyo (JP)

(72) Inventor: Chikara Imaizumi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/341,819

(22) Filed: Jun. 8, 2021

(65) Prior Publication Data

US 2021/0405557 A1 Dec. 30, 2021

(30) Foreign Application Priority Data

Jun. 30, 2020 (JP) ..... JP2020-113356
Apr. 27, 2021 (JP) ..... JP2021-075140

(51) Int. Cl.
*G03G 15/16* (2006.01)

(52) U.S. Cl.
CPC ..... *G03G 15/1615* (2013.01); *G03G 15/161* (2013.01); *G03G 2215/1623* (2013.01); *G03G 2221/1684* (2013.01)

(58) Field of Classification Search
CPC ..... G03G 15/161; G03G 15/1615; G03G 2215/1623; G03G 2221/1684
See application file for complete search history.

(56) References Cited

U.S. PATENT DOCUMENTS

2009/0304426 A1* 12/2009 Nakagaki ..... G03G 15/161 399/400
2015/0307307 A1* 10/2015 Goto ..... G03G 21/1633 399/13
2016/0266522 A1* 9/2016 Miyakoshi ..... G03G 15/162
2018/0224773 A1* 8/2018 Torimaru ..... G03G 21/00

FOREIGN PATENT DOCUMENTS

JP 2000275987 A 10/2000
JP 2011154293 A 8/2011
JP 2016166954 A 9/2016

* cited by examiner

*Primary Examiner* — Carla J Therrien
(74) *Attorney, Agent, or Firm* — Canon U.S.A., Inc. I.P. Division

(57) ABSTRACT

An image forming apparatus includes an image bearing member that bears a toner image, a transfer unit having an endless belt, a positioning unit that positions the transfer unit, and a secondary transfer member. The secondary transfer member is in touch with the endless belt to form a secondary transfer portion. When the toner image is transferred to the endless belt from the image bearing member, the secondary transfer member transfers the toner image from the endless belt at the secondary transfer portion to a transfer material. The positioning unit includes a first abutting face to position the transfer unit in a conveyance direction and a second abutting face to position the transfer unit in a direction opposite to the conveyance direction. An attaching/detaching direction of the transfer unit is a direction intersecting with a surface of the transfer material to which the toner image is transferred.

9 Claims, 22 Drawing Sheets

IMAGE FORMING APPARATUS

BACKGROUND

Field

The present disclosure relates to an image forming apparatus such as a printer or a copying machine employing an electrophotographic method, which includes a belt conveyance device having an endless belt.

Description of the Related Art

Conventionally, a color image forming apparatus including an intermediate transfer belt has been known as an image forming apparatus such as a printer or a copying machine employing an electrophotographic method. In order to allow a user to perform maintenance work of a transfer unit having an intermediate transfer belt, it is often the case that the above-described image forming apparatus includes a replaceable transfer unit which can be individually attached and detached to/from an apparatus main body of the image forming apparatus.

According to a configuration discussed in Japanese Patent Application Laid-Open No. 2000-275987, a transfer unit is attached or detached in a direction orthogonal to an axis line direction of an image bearing member, in which a plurality of image bearing bodies is arranged. More specifically, a guiding pin arranged on a transfer unit is guided along a guiding rail arranged on a frame of an apparatus main body, and positioning of the transfer unit is executed by abutting the guiding pin on a terminal face of the guiding rail. Further, according to the configuration discussed in Japanese Patent Application Laid-Open No. 2000-275987, a predetermined space between a width in the height direction of the guiding rail and a diameter of the guiding pin is provided as a fit tolerance.

However, with respect to the configuration discussed in Japanese Patent Application Laid-Open No. 2000-275987, the following issue may be considered because the fit tolerance between the guiding rail and the guiding pin is set with respect to a vertical direction (i.e., a direction intersecting with a face where a toner image is transferred to a transfer material) orthogonal to an attaching/detaching direction of the transfer unit. In other words, when image formation is executed, a positioning portion of the transfer unit is shifted by the amount of fit tolerance by receiving force in the vertical direction from a transfer material conveyed in the vertical direction. There is a risk of occurrence of image defect.

SUMMARY

The present disclosure is directed to a technique of precisely executing positioning of a transfer unit when image formation is executed by an image forming apparatus having a transfer unit capable of being attached or detached in a direction intersecting with a face onto which a toner image is transferred a transfer material.

According to an aspect of the present disclosure, an image forming apparatus includes an image bearing member configured to bear a toner image, a transfer unit including an endless belt, a plurality of stretching members that is rotatable, and a primary transfer member, wherein the endless belt is stretched around the plurality of stretching members, is configured to rotationally-move, and is capable of touching with the image bearing member, and wherein the primary transfer member is arranged on an inner circumferential face side of the endless belt and is configured to transfer the toner image borne on the image bearing member to the endless belt, a positioning unit configured to position the transfer unit, a secondary transfer member in touch with the endless belt to form a secondary transfer portion, wherein, in a case where the toner image is transferred to the endless belt from the image bearing member, the secondary transfer member is configured to transfer the toner image from the endless belt at the secondary transfer portion to a transfer material, and an urging member configured to urge the secondary transfer member toward a facing member, wherein the facing member is one of the plurality of stretching members and is arranged at a position facing the secondary transfer member via the endless belt, wherein, when viewed in a rotation axis line direction of the facing member, a conveyance direction of the transfer material at the secondary transfer portion is a direction orthogonal to a line that connects a rotation center of the secondary transfer member and a rotation center of the facing member, and an attaching/detaching direction of the transfer unit is a direction intersecting with a surface of the transfer material to which the toner image is transferred at the secondary transfer portion, wherein, when viewed in the rotation axis line direction of the facing member, the transfer unit includes an abutting portion which is arranged so that the abutting portion at least partially overlaps the facing member, wherein the positioning unit includes a first abutting face which abuts on the abutting portion to position the transfer unit in the conveyance direction and a second abutting face which abuts on the abutting portion to position the transfer unit in a direction opposite to the conveyance direction in a state where the transfer unit receives urging force from the urging member via the secondary transfer member, wherein, when viewed in the rotation axis line direction of the facing member, the second abutting face is arranged on an upstream side of the first abutting face in the conveyance direction, and the first abutting face and the second abutting face are faces extending in a direction intersecting with the conveyance direction, and wherein the first and the second abutting faces are arranged so that a space between the first and the second abutting faces is increased toward the upstream side in an attaching direction of the transfer unit.

Further features of the present disclosure will become apparent from the following description of exemplary embodiments with reference to the attached drawings.

DESCRIPTION OF THE EMBODIMENTS

Hereinafter, exemplary embodiments embodying the present disclosure will be illustratively described in detail with reference to the appended drawings. Herein, sizes, materials, and shapes of constituent elements described in the below-described exemplary embodiments and a relative arrangement thereof should be changed as appropriate depending on a configuration or various conditions of the apparatus to which the present disclosure is applied. Accordingly, a scope of the present disclosure is not intended to be limited thereto unless such specific limitations are described in particular.

<Configuration of Image Forming Apparatus>

Figure 1:
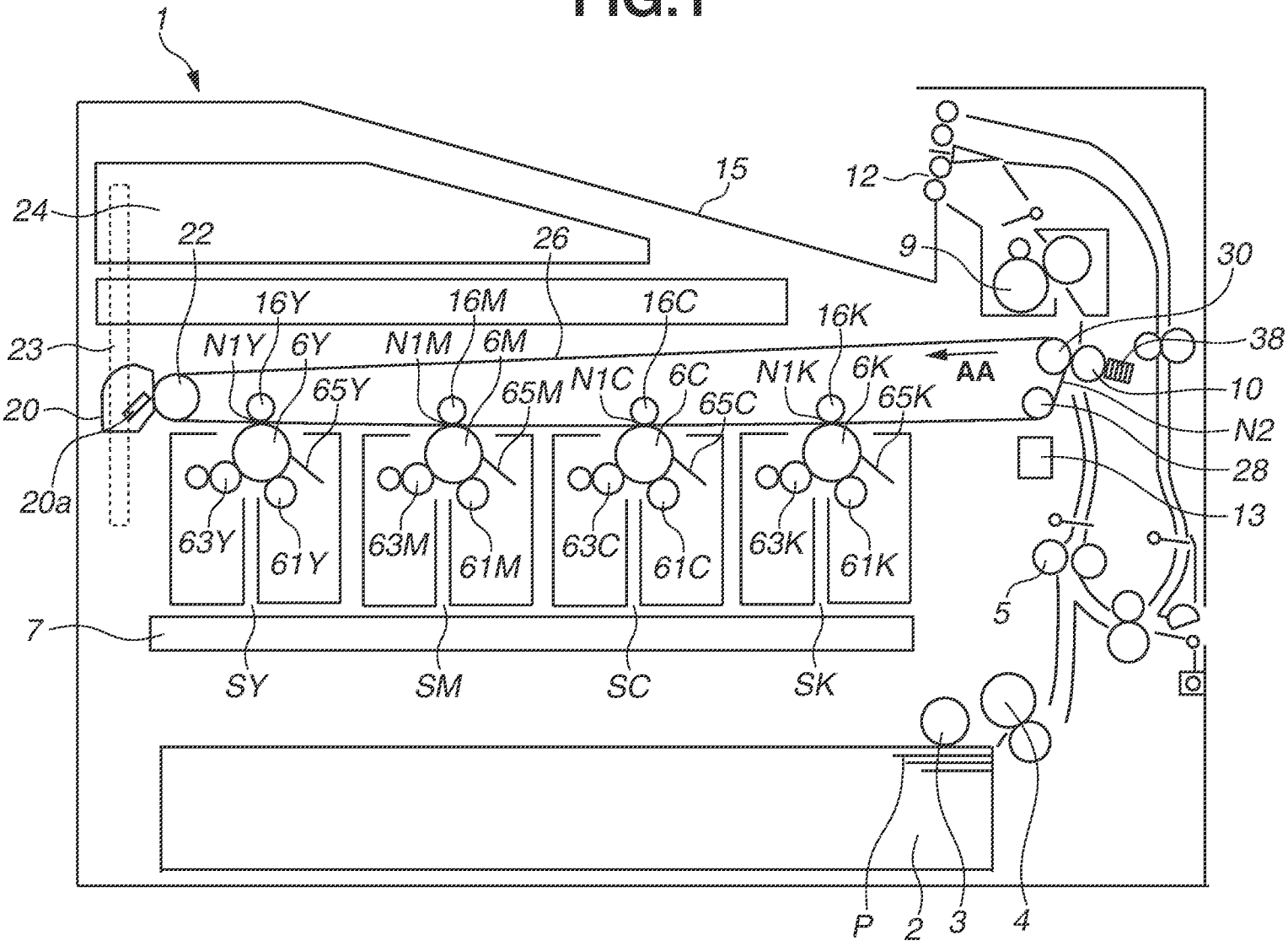
FIG. 1 is a schematic cross-sectional diagram illustrating a configuration of an image forming apparatus according to a first exemplary embodiment.

A first exemplary embodiment will be described. FIG. 1 is a diagram illustrating a schematic configuration of an image forming apparatus 1 according to the present exemplary embodiment. As illustrated in FIG. 1, the image forming apparatus 1 according to the present exemplary embodiment is an intermediate-transfer color image forming apparatus employing an electrophotographic method, which includes a first, a second, a third, and a fourth image forming units SY, SM, SC, and SK as a plurality of image forming units. The first, the second, the third, and the fourth image forming units SY, SM, SC, and SK form images of respective colors of yellow (Y), magenta (M), cyan (C), and black (Bk). These four image forming units SY, SM, SC, and SK are arranged in a row at regular intervals. Further, in the present exemplary embodiment, the image forming units SY, SM, SC, and SK are arranged below an intermediate transfer belt 26 in a gravitational direction. Furthermore, in the present exemplary embodiment, configurations of the first to the fourth image forming units SY, SM, SC, and SK are substantially the same except for the colors of toner used thereby. Accordingly, the image forming units SY, SM, SC, and SK will be collectively described while the trailing symbols "Y", "M", "C", and "K" added to the reference symbol "S" which represent the respective colors are omitted, unless it is necessary to distinguish one from the others.

A drum-shaped electro-photosensitive body 6 (hereinafter, called "photosensitive drum 6") serving as a rotatable image bearing member for forming a toner image is arranged on each of the image forming units S. A charging roller 61 as a charging member for charging the photosensitive drum 6, a development unit, and a cleaning unit are arranged in a periphery of the photosensitive drum 6. Further, an exposed portion irradiated with laser light emitted from an exposure unit 7 (i.e., laser scanner) is arranged at a position on the downstream side of the charging roller 61 and the upstream side of a development unit in a rotation direction of the photosensitive drum 6.

The development unit includes a development roller 63 as a development member and toner as developer. The development roller 63 can be rotated by receiving driving force from a driving source (not illustrated). The cleaning unit includes a cleaning blade 65 as a cleaning member abutting on the photosensitive drum 6, and accommodates toner collected by the cleaning blade 65.

Next, a general configuration of the image forming apparatus 1 will be described. As illustrated in FIG. 1, an intermediate transfer belt 26, which is an endless intermediate transfer body, is arranged to face the photosensitive drums 6 of the image forming units S. The intermediate transfer belt 26 is stretched around a plurality of stretching members. More specifically, the intermediate transfer belt 26 is stretched around three stretching rollers, i.e., a driving roller 30 (facing member), a driven roller 28, and a tension roller 22. Further, the intermediate transfer belt 26 can be rotationally moved in a direction AA indicated by an arrow in FIG. 1 due to the rotation of the driving roller 30 that is rotated by receiving driving force from a driving source (not illustrated).

A primary transfer roller 16 as a primary transfer member (transfer member) is arranged on an inner circumferential face side of the intermediate transfer belt 26, at a position facing the photosensitive drum 6. The primary transfer roller 16 is urged toward the photosensitive drum 6 via the intermediate transfer belt 26 at a predetermined pressure, so that a primary transfer portion (primary transfer nip) N1 at which the intermediate transfer belt 26 is in contact with the photosensitive drum 6 is formed. Further, a primary transfer power source (not illustrated) is connected to the primary transfer roller 16, so that the primary transfer power source can apply voltage of positive or negative polarity to the primary transfer roller 16.

A secondary transfer roller 10 as a secondary transfer member is arranged on an outer circumferential face side of the intermediate transfer belt 26, at a position facing the photosensitive drum 6. The secondary transfer roller 10 is urged toward the driving roller 30 via the intermediate transfer belt 26 by a spring 38 serving as an urging member at a predetermined pressure, so that a primary transfer portion (primary transfer nip) N2 at which the intermediate transfer belt 26 is in contact with the secondary transfer roller 10 is formed. A secondary transfer power source (not illustrated) is connected to the secondary transfer roller 10, so that the secondary transfer power source can apply voltage of positive or negative polarity to the secondary transfer roller 10.

A cleaning unit 20 which collects toner (hereinafter, called "residual toner") remaining in the intermediate transfer belt 26 after execution of the secondary transfer processing is arranged at a position on an upstream side of the photosensitive drums 6 and a downstream side of the secondary transfer portion N2 in the moving direction of the intermediate transfer belt 26. The cleaning unit 20 includes a cleaning blade 20*a* abutting on the intermediate transfer belt 26.

A sheet-feeding cassette 2 for storing transfer materials P, a sheet-feeding roller 3 for feeding a transfer material P, and conveyance rollers 4 and 5 for conveying a transfer material P to the secondary transfer portion N2 are arranged on an upstream side of the secondary transfer portion N2 in the conveyance direction of the transfer material P. Further, a fixing unit 9 having a thermal source, a sheet-discharge roller 12 for discharging a transfer material P from the image forming apparatus 1, and a sheet-discharge tray 15 for stacking a discharged transfer material P are arranged on a downstream side of the secondary transfer portion N2 in the conveyance direction of the transfer material P.

<Image Forming Operation>

When a host apparatus (not illustrated) transmits an operation start instruction and an image signal to a controller (not illustrated) serving as a control unit, the controller controls various units to start image forming operation of the image forming apparatus 1. When the image forming operation is started, the photosensitive drums 6, the intermediate transfer belt 26, and the development rollers 63 respectively start rotating at predetermined rotation speed by receiving driving force from driving sources (not illustrated). A surface of each of the rotating photosensitive drums 6 is uniformly charged in a predetermined polarity (in the present exemplary embodiment, a negative polarity) by the charging roller 61. At this time, a predetermined charging voltage is applied to the charging roller 61 from a charging power source. Thereafter, each of the photosensitive drums 6 is exposed to light emitted from the exposure unit 7 based on image information depending on each of the image forming units S, so that an electrostatic latent image based on the image information is formed on a surface of each of the photosensitive drums 6.

Each of the development rollers 63 bears toner charged in the normal charging polarity of the toner (in the present exemplary embodiment, a negative polarity), and receives a predetermined development voltage from a development power source. With this operation, at a facing portion (development portion) of the photosensitive drum 6 and the development roller 63, the latent image formed on the photosensitive drum 6 is visualized with toner charged in the negative polarity, so that a toner image is formed on the photosensitive drum 6.

Then, electric current flowing from the primary transfer roller 16 to the photosensitive drum 6 (hereinafter, called "primary transfer current") causes the toner image formed on the photosensitive drum 6 to be transferred (primarily transferred) to the rotationally-driven intermediate transfer belt 26 at the primary transfer portion N1. At this time, voltage of a polarity opposite to the normal charging polarity of toner (in the present exemplary embodiment, a positive polarity) is applied to the primary transfer roller 16 from the primary transfer power source. In other words, in the configuration according to the present exemplary embodiment, a toner image is primarily transferred to the intermediate transfer belt 26 from the photosensitive drum 6 by constant current control which controls the output of the primary transfer power source to make a predetermined constant transfer current flow from the primary transfer roller 16 to the photosensitive drum 6.

When a full-color image is to be formed, electrostatic latent images are formed on the photosensitive drums 6 of the respective image forming units S, and these electrostatic latent images are developed to toner images of respective colors. Then, the toner images of respective colors formed on the photosensitive drums 6 of the image forming units S are sequentially superimposed and transferred onto the intermediate transfer belt 26 at the primary transfer portions N1Y, N1M, N1C, and N1K, so that a four-color toner image is formed on the intermediate transfer belt 26.

Further, each of the transfer materials P stacked on the sheet-feeding cassette 2, which is a container unit, is fed to the conveyance roller 4 by the sheet-feeding roller 3 and conveyed to the secondary transfer portion N2 by the conveyance rollers 4 and 5. Then, the electric current flowing from the secondary transfer roller 10 to the intermediate transfer belt 26 (hereinafter, called "secondary transfer current) causes the four-color multi-superimposed toner image borne on the intermediate transfer belt 26 to be transferred (secondarily transferred) to the conveyed transfer material P at the secondary transfer portion N2. At this time, secondary transfer voltage of a polarity opposite to the normal charging polarity of toner (in the present exemplary embodiment, a positive polarity) is applied to the secondary transfer roller 10 from the secondary transfer power source. In other words, in the configuration according to the present exemplary embodiment, a toner image is secondarily transferred to the transfer material P from the intermediate transfer belt 26 by constant current control which controls the output of the second transfer power source to make a predetermined secondary transfer current flow from the secondary transfer roller 10 to the intermediate transfer belt 26.

Thereafter, the transfer material P on which the toner image is transferred is conveyed to the fixing unit 9, so that the toner image is fixed on a surface of the transfer material P. Then, the transfer material P is discharged to the outside of the apparatus main body of the image forming apparatus 1 and stacked on the sheet-discharge tray 15.

In addition, toner remaining in the photosensitive drum 6 after execution of the primary transfer operation is removed from the surface of the photosensitive drum 6 by the cleaning blade 65. Further, transfer residual toner remaining in the intermediate transfer belt 26 after the transfer material P has passed through the secondary transfer portion N2 is removed from the surface of the intermediate transfer belt 26 by the cleaning blade 20*a*. Thereafter, removed toner passes through a toner conveyance path 23, so as to be accommodated in a toner collection container 24.

<Calibration Operation>

The toner images are sequentially superimposed and transferred onto the intermediate transfer belt 26, so that a four-color toner image is formed on the intermediate transfer belt 26. However, depending on the factors such as variation in components of the image forming apparatus 1, change of a resistance value of the intermediate transfer belt 26 or wear and tear of the photosensitive drum 6 due to change of the installation environment, positions where the toner images are superimposed on the intermediate transfer belt 26 or density values of the toner images of respective colors may be deviated from what they assumed to be. In order to correct the above-described deviation, the controller (not illustrated) executes adjustment control to adjust positions where toner images are transferred and density values thereof by transferring toner images of predetermined patterns on the intermediate transfer belt 26 and reading the transferred patterns by a sensor 13. When the adjustment control is executed, pattern data read by the sensor 13 is transmitted to the controller (not illustrated) and calculated and processed thereby. Then, based on the processing result, a timing at which the photosensitive drum 6 is exposed to light and an exposure time thereof are adjusted by the exposure unit 7.

<Intermediate Transfer Unit>

Figure 2:
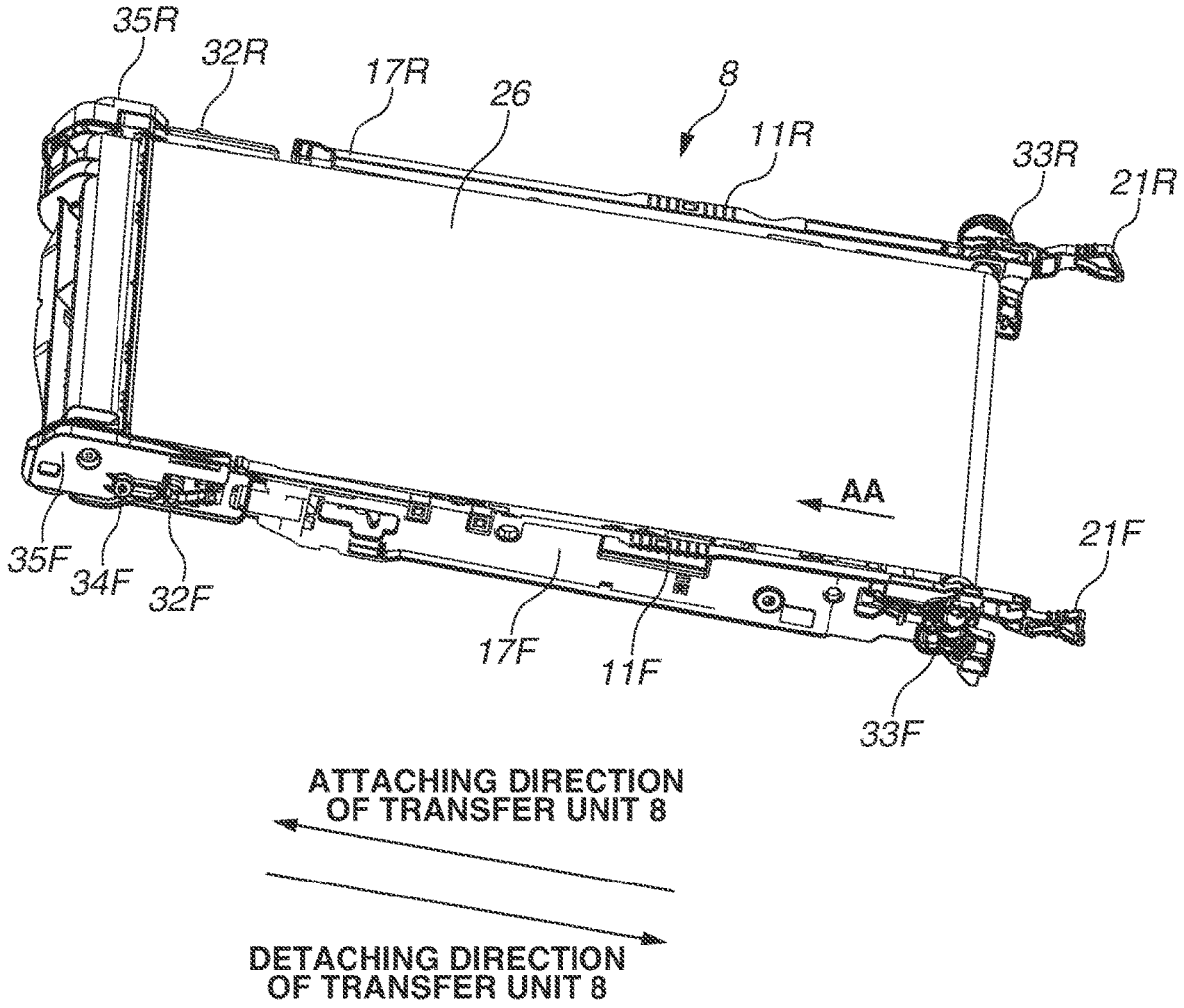
FIG. 2 is a schematic perspective diagram illustrating a configuration of a transfer unit according to the first exemplary embodiment.
Figure 3:
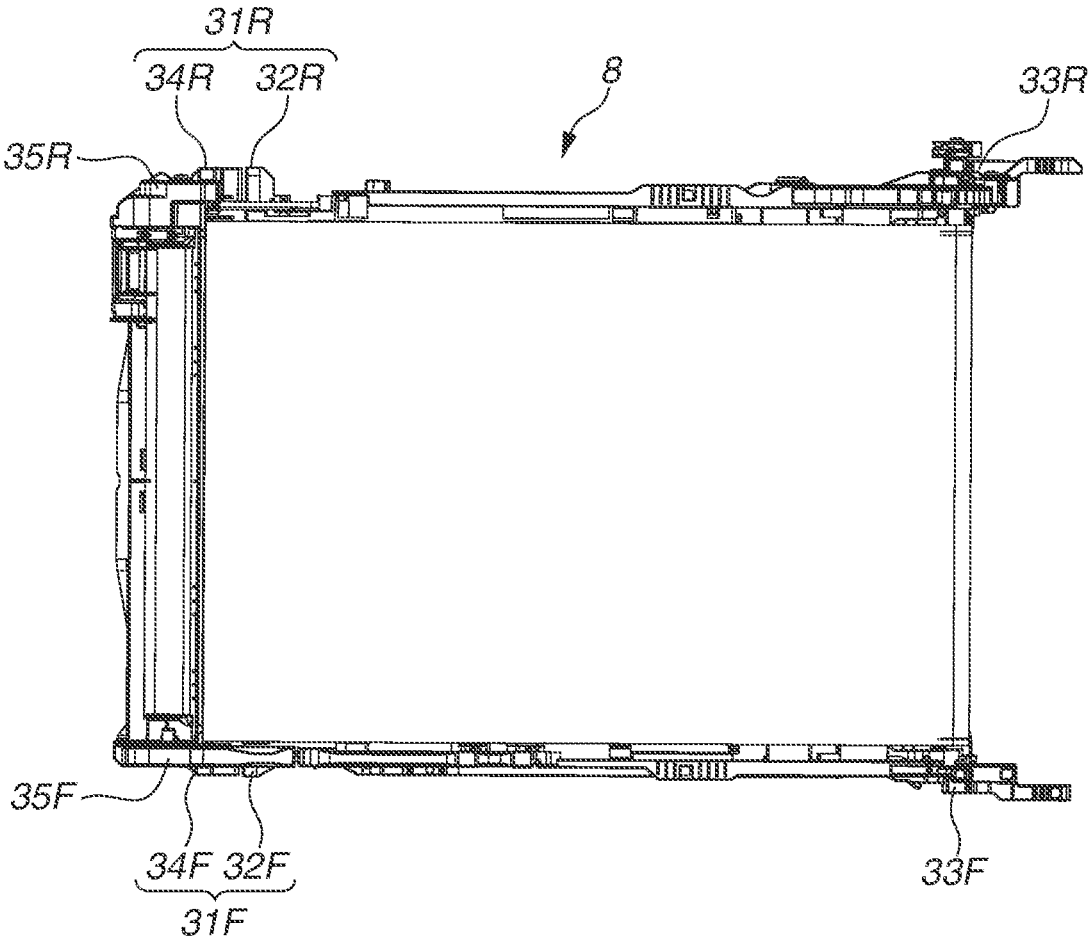
FIG. 3 is a schematic top plan view illustrating a configuration of the transfer unit according to the first exemplary embodiment.

Next, a configuration in a periphery of a transfer unit 8 (i.e., belt conveyance apparatus) included in the image forming apparatus 1 will be described with reference to FIGS. 2, 3, 4, 5, 6A, 6B, and 7. FIG. 2 is a schematic perspective diagram illustrating a configuration of the transfer unit 8. FIG. 3 is a schematic top plan view illustrating the configuration of the transfer unit 8.

As illustrated in FIGS. 2 and 3, the transfer unit 8 includes transfer frames 17F and 17R on both sides in a width direction of the intermediate transfer belt 26 (hereinafter, simply called "belt width direction") orthogonal to a moving direction (the direction AA indicated by the arrow in FIG. 2) of the intermediate transfer belt 26. The transfer frames 17F and 17R face each other in the belt width direction, i.e., a rotation axis line direction of the driving roller 30. Further, the intermediate transfer belt 26 stretched around the three stretching rollers, i.e., the driving roller 30, the driven roller 28, and the tension roller 22, is arranged on the inner side of the two transfer frames 17F and 17R.

Although details will be described below, the transfer unit 8 can be detached from the image forming apparatus 1 by moving the transfer unit 8 in a direction heading toward the secondary transfer roller 10 from the cleaning unit 20 in FIG. 1. Further, the transfer unit 8 can be attached to the image forming apparatus 1 by moving the transfer unit 8 in a direction heading toward the cleaning unit 20 from the secondary transfer roller 10 in FIG. 1. A direction for attaching/detaching the transfer unit 8 in the present exemplary embodiment is a direction intersecting a surface of the transfer material P on which a toner image is secondarily transferred at the secondary transfer portion N2 in FIG. 1. In other words, the attaching/detaching direction is a direction intersecting the conveyance direction of the transfer material P at the secondary transfer portion N2. The conveyance direction of the transfer material P at the secondary transfer portion N2 is defined as a direction crossing a straight line that connects a rotation center of the driving roller 30 and a rotation center of the secondary transfer roller 10 when viewed in the axis line direction of the driving roller 30. Further, a vertical direction in the present exemplary embodiment is a direction substantially the same as the gravitational direction.

As illustrated in FIGS. 2 and 3, bosses 32F and 32R are arranged on a downstream side in the attaching direction of the transfer unit 8. Further, bosses 33F and 33R serving as abutting portions are arranged on an upstream side in the attaching direction of the transfer unit 8, at positions coaxial with the driving roller 30 (i.e., a position on the same axis line).

The bosses 32F and 33F are arranged to be projected from the transfer frame 17F on one side in the belt width direction. Specifically, the bosses 32F and 33F are projected in a direction away from the intermediate transfer belt 26 (i.e., a side opposite to a side of the intermediate transfer belt 26) in the belt width direction (i.e., the rotation axis line direction of the driving roller 30).

Further, the bosses 32R and 33R are arranged to be projected from the transfer frame 17R on the other side in the belt width direction. Specifically, the bosses 32R and 33R are projected in a direction away from the intermediate transfer belt 26 (i.e., a side opposite to a side of the intermediate transfer belt 26) in the belt width direction (i.e., the rotation axis line direction of the driving roller 30).

In the present exemplary embodiment, although the bosses 33F and 33R (abutting portions) are arranged at positions coaxial with the driving roller 30 (i.e., positions on the same axis line), the bosses 33F and 33R do not have to be arranged coaxially therewith. In other words, the bosses 33F and 33R (abutting portions) may be arranged so that at least a part of the bosses 33F and 33R overlaps with the driving roller 30 when viewed in the rotation axis line direction of the driving roller 30.

For example, the bosses 33F and 33R (abutting portions) can be arranged on an inner side of an area occupied by the driving roller 30 when viewed in the rotation axis line direction of the driving roller 30. Further, the centers (axial cores) of the bosses 33F and 33R should preferably be arranged on the inner side of the area occupied by the driving roller 30.

Further, the transfer unit 8 includes covers 35F and 35R for holding the tension roller 22 on the upstream side in the detaching direction. The covers 35F and 35R are arranged with play of approximately 0.5 mm on both of the upper and lower sides of the transfer frames 17F and 17R, so that the covers 35F and 35R are independently movable with respect to the transfer frames 17F and 17R. Bosses 34F and 34R are respectively arranged on the covers 35F and 35R, at positions coaxial with the tension roller 22 (i.e., positions on the same axis line).

Although details will be described below, these bosses 32F, 32R, 34F, and 34R function as guiding portions when the transfer unit 8 is attached to the apparatus main body of the image forming apparatus 1. By arranging the projected bosses 34F, 34R, 33F, and 33R at positions coaxial with the tension roller 22 and the driving roller 30, positioning of the various rollers, which is important when attachment work of the transfer unit 8 is executed, can be executed precisely with respect to the apparatus main body of the image forming apparatus 1. Further, in the present exemplary embodiment, the bosses 32F and 32R located adjacent to the tension roller 22 are arranged at a distance from the bosses 33F and 33R located at positions coaxial with the driving roller 30. With this configuration, when the transfer unit 8 is attached to the image forming apparatus 1, positional deviation of the main body of the transfer unit 8 can be reduced by precisely positioning the orientation of the transfer frames 17F and 17R.

Further, as illustrated in FIG. 2, holding portions 21F and 21R which the user can hold to attach the transfer unit 8 to the image forming apparatus 1 are arranged on end portions on the upstream side in the attaching direction of the transfer unit 8. Furthermore, holding portions 11F and 11R which the user can hold to attach the transfer unit 8 to the image forming apparatus 1 are arranged on the transfer unit 8. The holding portions 11F and 11R are arranged on the downstream side of the holding portions 21F and 21R in the attaching direction of the transfer unit 8. The holding portions 11F and 21F are arranged on the transfer frame 17F as one end portion in the belt width direction, whereas the holding portions 11R and 21R are arranged on the transfer frame 17R as the other end portion in the belt width direction.

Figure 4:
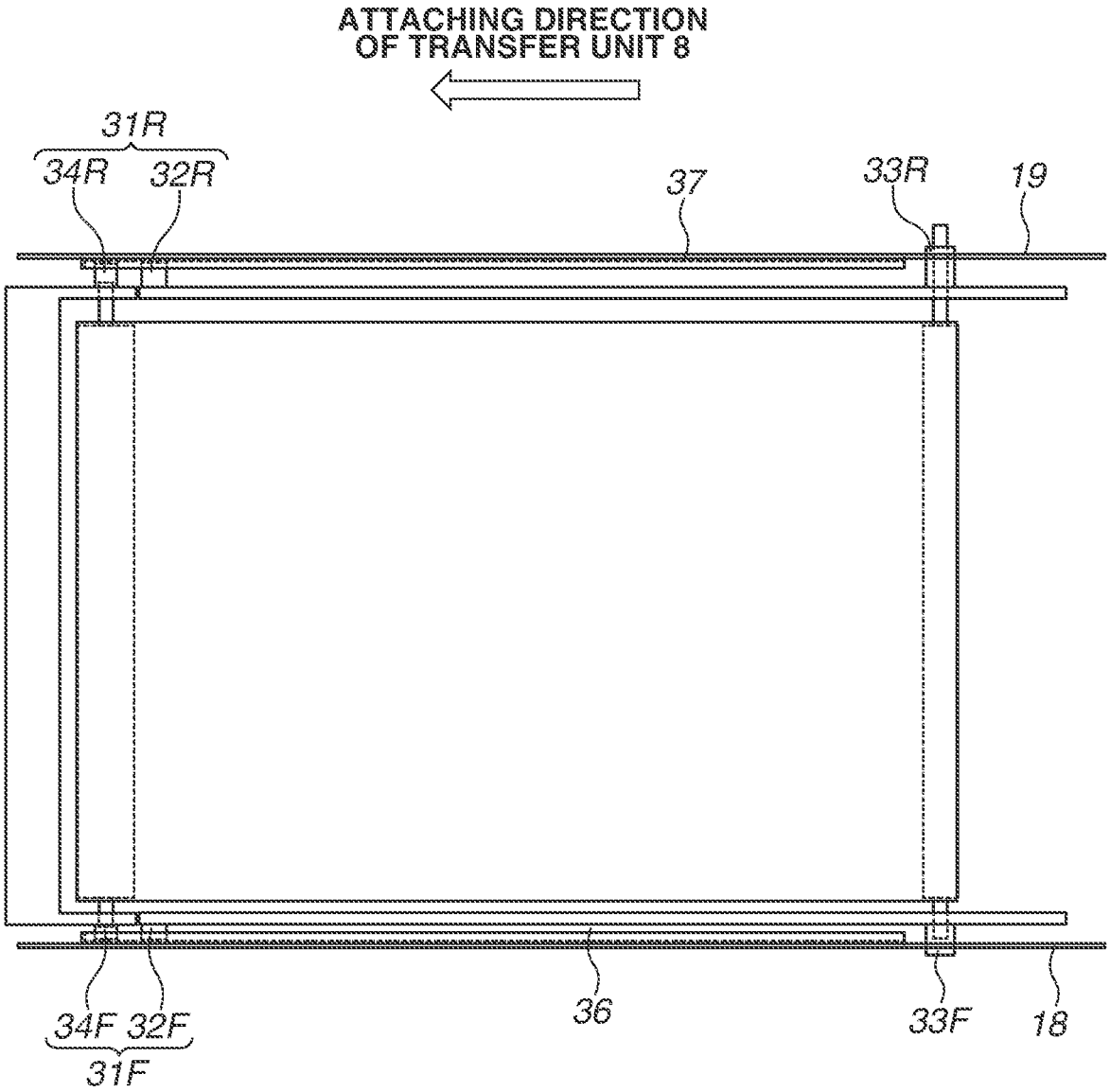
FIG. 4 is a simplified schematic top plan view illustrating the transfer unit according to the first exemplary embodiment attached to a main body of an apparatus.

FIG. 4 is a simplified schematic top plan view illustrating the transfer unit 8 attached to the apparatus main body of the image forming apparatus 1. As illustrated in FIG. 4, the image forming apparatus 1 includes a frame 18 arranged on one end of the transfer unit 8 in the belt width direction and a frame 19 arranged on the other end of the transfer unit 8 in the belt width direction. The frames 18 and 19 are arranged to face each other in the belt width direction, and the transfer unit 8 is arranged between the frames 18 and 19 in the belt width direction when the transfer unit 8 is attached to the image forming apparatus 1.

As illustrated in FIG. 4, on one side in the belt width direction which the transfer unit 8 is arranged, a guiding rail 36 serving as a guiding member having a rail groove for guiding the bosses 32F and 34F provided on the transfer unit 8 is arranged on the frame 18. Further, on one side in the belt width direction which the transfer unit 8 is arranged, a guiding rail 37 serving as a guiding member having a rail groove for guiding the bosses 32R and 34R provided on the transfer unit 8 is arranged on the frame 19. The rail grooves of the guiding rails 36 and 37 have shapes expressed by dashed lines in FIG. 4. In the below-described exemplary embodiment, the bosses 32F and 34F arranged on the downstream side in the attaching direction of the transfer unit 8 are collectively called leading end bosses 31F, and the bosses 32R and 34R arranged on the downstream side thereof are collectively called leading end bosses 31R. The leading end bosses 31F and 31R constitute guiding portions for guiding the transfer unit 8 along the guiding rails 36 and 37 when the transfer unit 8 is attached or detached.

<Attachment/Detachment Work of Transfer Unit>

Next, attachment/detachment work of the transfer unit 8 and various constituent elements of the transfer unit 8 relating to the attachment/detachment work will be described with reference to FIGS. 5 to 13. Herein, most of the elements constituting one end and the other end of the transfer unit 8 in the belt width direction are similar to each other except for some exceptions. Therefore, the configuration of the transfer unit 8 is practically symmetrical in the belt width direction. Accordingly, in the below-described exemplary embodiment, the configuration will be described with respect to a side of the frame 18 as one end in the belt width direction, and description will be omitted with respect to the configuration on a side of the frame 19 as the other end in the belt width direction unless it is necessary to distinguish one from another.

Figure 5:
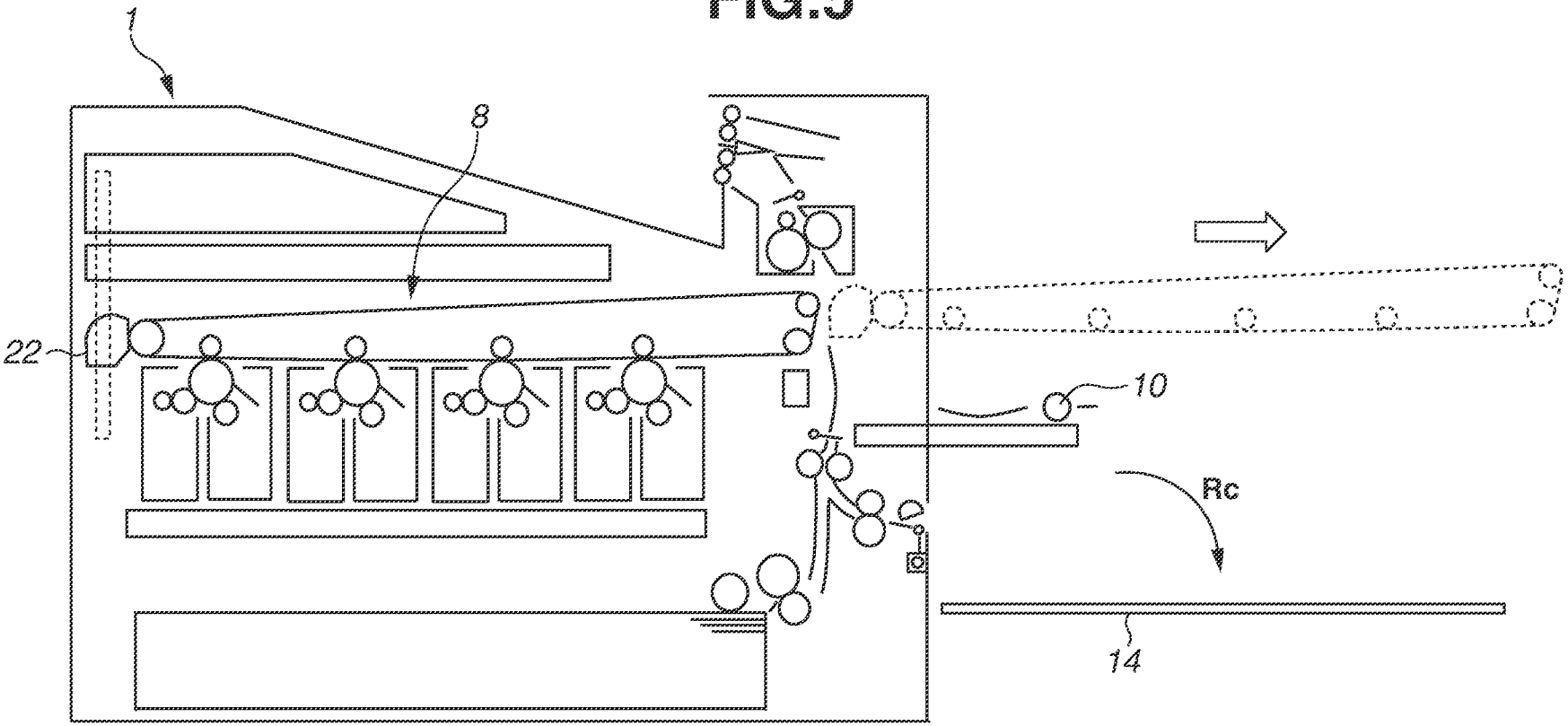
FIG. 5 is a schematic cross-sectional diagram illustrating attachment and detachment of the transfer unit according to the first exemplary embodiment.

FIG. 5 is a schematic diagram illustrating extraction (detachment) of the transfer unit 8 from the apparatus main body of the image forming apparatus 1. As illustrated in FIG. 5, the image forming apparatus 1 includes an openable/closeable door 14 as an opening/closing unit. Further, as illustrated in FIG. 5, the secondary transfer roller 10 can be opened/closed in a direction the same as the opening/closing direction of the door 14 together with the members that hold the secondary transfer roller 10.

As illustrated in FIG. 5, when attachment/detachment work of the transfer unit 8 is to be executed, the user rotationally moves the door 14 and the secondary transfer roller 10 in a direction Rc indicated by an arrow in FIG. 5 to open the inner portion of the image forming apparatus 1. In the configuration according to the present exemplary embodiment, a mechanism (not illustrated) which makes the secondary transfer roller 10 open or close in conjunction with the opening/closing movement of the door 14 is provided. Therefore, the user can also rotate the secondary transfer roller 10 in the direction Rc by rotating the door 14 in the direction Rc, so that the inner portion of the image forming apparatus 1 is uncovered. In the present exemplary embodiment, the mechanism which makes the secondary transfer roller 10 open or close in conjunction with the opening/closing movement of the door 14 is provided. However, the configuration is not limited thereto, and a mechanism which makes the door 14 and the secondary transfer roller 10 open or close separately can also be employed.

In a state where the inner portion of the image forming apparatus 1 is open as illustrated in FIG. 5, the user can detach the transfer unit 8 from the apparatus main body of the image forming apparatus 1 by extracting the transfer unit 8 in a retreat direction of the secondary transfer roller 10 (i.e., a direction indicated by a white arrow in FIG. 5). Further, when the transfer unit 8 is to be attached to the apparatus main body of the image forming apparatus 1, the user cancels the open state of the inner portion of the image forming apparatus 1 by closing the secondary transfer roller 10 and the door 14 after inserting the transfer unit 8 in a direction opposite to the direction indicated by the white arrow in FIG. 5.

When the transfer unit 8 is in an attached state, the secondary transfer roller 10 is rotated and moved to a position where the image forming operation can be executed, so that the transfer unit 8 receives urging force from the spring 38 which urges the secondary transfer roller 10 toward the driving roller 30. Although details will be described below, in the present exemplary embodiment, due to the urging force from the secondary transfer roller 10, the bosses 33F and 33R of the transfer unit 8 are respectively urged toward and abut on the frames 18 and 19 serving as the positioning units, so that the transfer unit 8 is positioned.

Figure 6A:
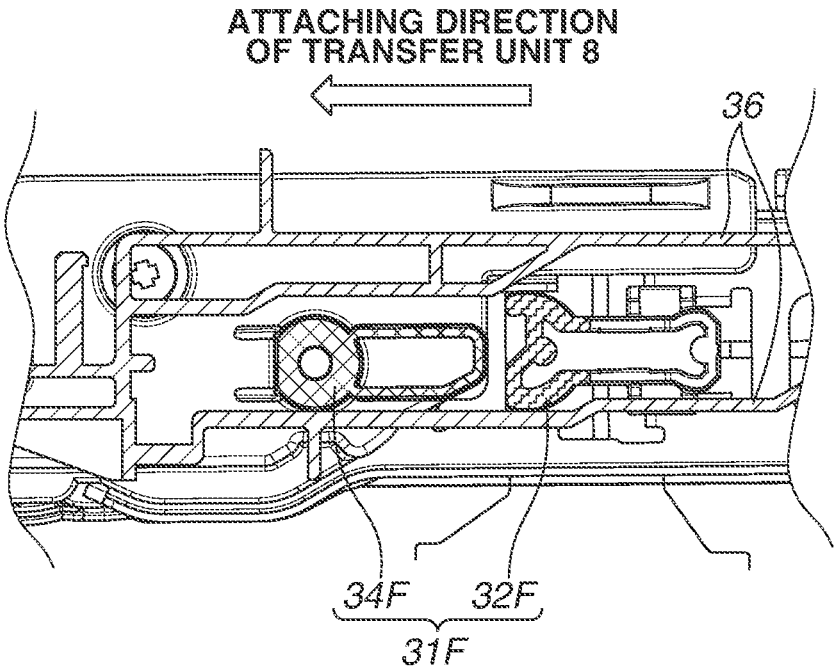
FIGS. 6A and 6B are schematic diagrams illustrating a relationship between a guiding portion and a guiding rail when attachment of the transfer unit according to the first exemplary embodiment is completed.
Figure 6B:
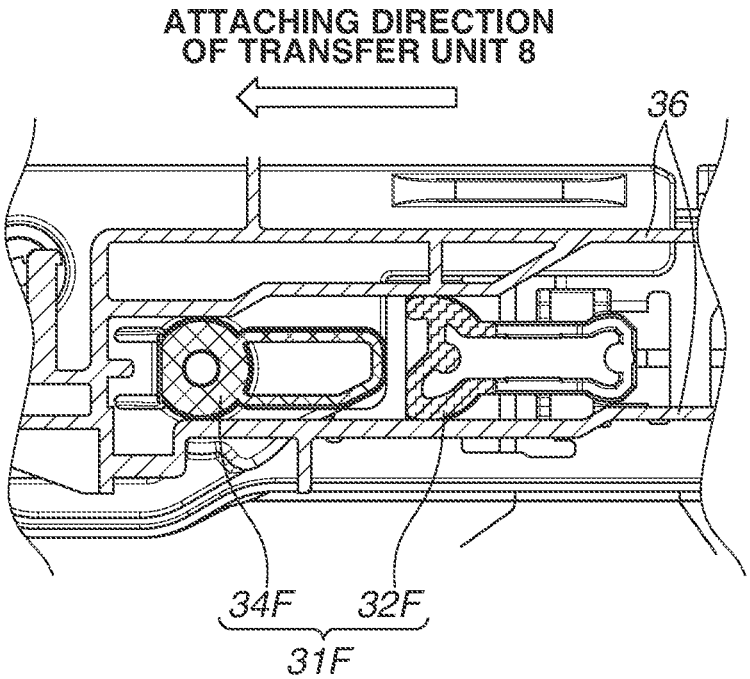

FIG. 6A is a schematic cross-sectional diagram illustrating a relationship between the leading end bosses 31F and the guiding rail 36 before attachment work of the transfer unit 8 is completed, viewed in the rotation axis line direction of the driving roller 30. FIG. 6B is a schematic cross-sectional diagram viewed in the rotation axis line direction of the driving roller 30, illustrating a relationship between the leading end bosses 31F and the guiding rail 36 after attachment work of the transfer unit 8 is completed.

As illustrated in FIG. 6A, before attachment work of the transfer unit 8 is completed, there is a space between the leading end bosses 31F and the guiding rail 36 in the vertical direction orthogonal to the attaching direction of the transfer unit 8. Therefore, the transfer unit 8 can be attached smoothly without generating excessive friction between the leading end bosses 31F and the guiding rail 36. On the other hand, as illustrated in FIG. 6B, after attachment work of the transfer unit 8 is completed, the leading end bosses 31F are held between the guide-shaped portions of the guiding rail 36 in the vertical direction. In this way, a portion on the downstream side (leading end side) in the attaching direction of the transfer unit 8 is positioned with respect to the apparatus main body of the image forming apparatus 1 in the vertical direction.

Figure 7:
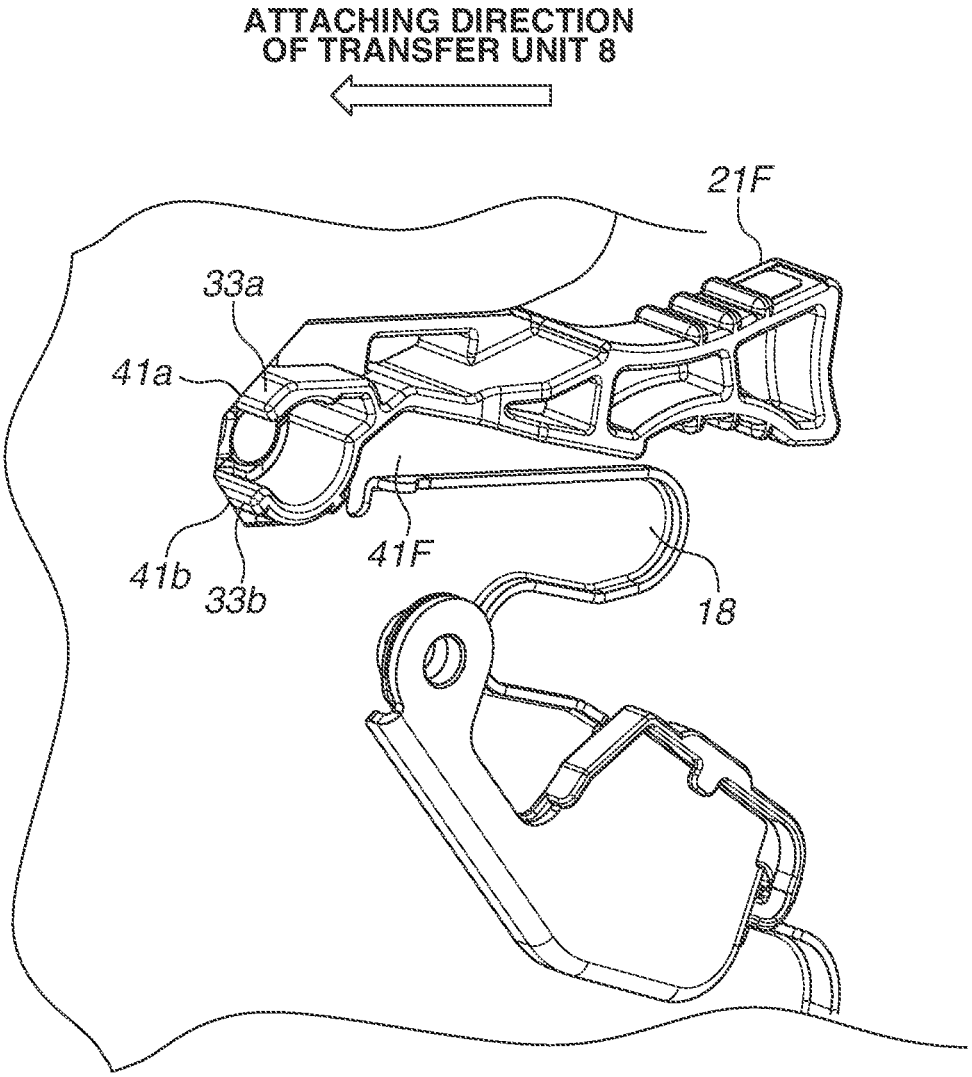
FIG. 7 is a partial perspective diagram illustrating a positioning portion of the transfer unit according to the first exemplary embodiment attached to a frame.

FIG. 7 is a schematic perspective diagram illustrating a configuration of an end portion and a periphery of the transfer unit 8 on the upstream side in the attaching direction when the transfer unit 8 is attached to the image forming apparatus 1. As illustrated in FIG. 7, the boss 33F arranged on the transfer unit 8 includes abutting portions 33*a* and 33*b* capable of respectively abutting on abutting faces 41*a* (first abutting face) and 41*b* (second abutting face) arranged on the frame 18 serving as a positioning unit. The abutting faces 41*a* and 41*b* are arranged on a cutout portion 41F formed by cutting out the frame 18. The abutting faces 41*a* and 41*b* are arranged to face each other in the vertical direction, which is the conveyance direction of the transfer material P, and the abutting face 41*b* is arranged below the abutting face 41*a* in the vertical direction. Further, each of the abutting faces 41*a* and 41*b* has an inclined face extending in a direction intersecting with the conveyance direction of the transfer material P, and a space between the inclined faces is increased toward the upstream side in the attaching direction of the transfer unit 8.

When the transfer unit 8 is attached to the image forming apparatus 1, the abutting face 41*a* abuts on the abutting portion 33*a*, and the abutting face 41*b* abuts on the abutting portion 33*b*. Then, the urging force of the secondary transfer roller 10 urged toward the driving roller 30 causes the abutting portions 33*a* and 33*b* arranged coaxially with the driving roller 30 to be respectively urged toward the abutting faces 41*a* and 41*b*. In this way, the transfer unit 8 is positioned in the attaching/detaching direction of the transfer unit 8.

Further, in the present exemplary embodiment, as illustrated in FIG. 7, the holding portion 21F is arranged so that at least the holding portion 21F and the cutout portion 41F of the frame 18 partially overlap with each other in the belt width direction (i.e., the rotation axis line direction of the driving roller 30 constituting the facing member). With this configuration, an internal space of the image forming apparatus 1 can be utilized effectively. Further, when attachment work is executed, the user holds the holding portion 21F and pushes the transfer unit 8 toward the apparatus main body. By employing the above-described configuration, a position at which the user applies force in the attaching direction at the time of attachment work and a position at which the boss 33F abuts on the frame 18 can be closely arranged to each other. When the attachment work of the transfer unit 8 is executed, the force applied by the user can easily be transmitted to the transfer unit 8 directly, so that the user's operability will be improved.

Next, attachment work of a new replacement transfer unit 8 to the apparatus main body of the image forming apparatus 1 and a positioning structure of the transfer unit 8 will be described with reference to FIGS. 8 to 13.

Figure 8:
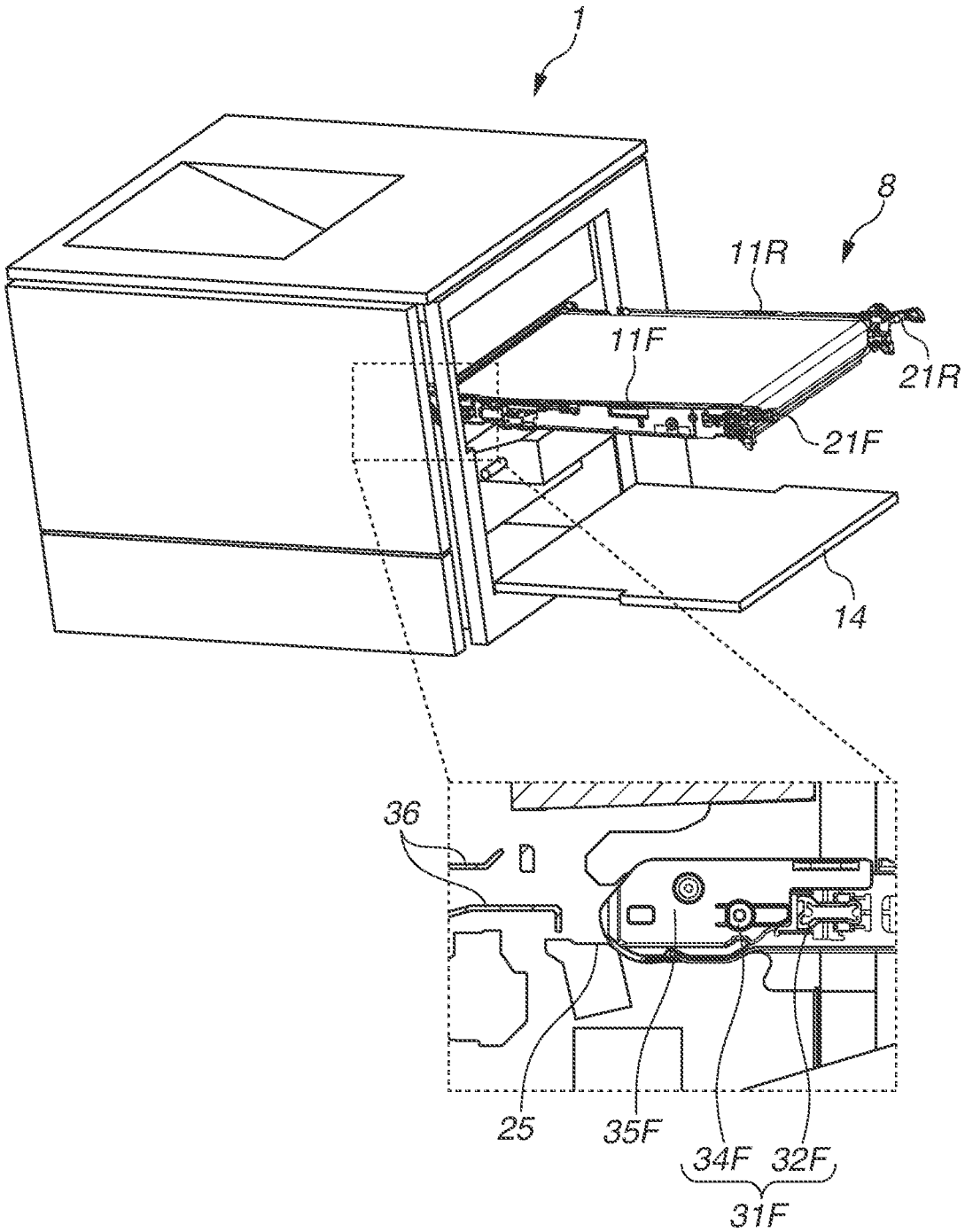
FIG. 8 is a schematic perspective diagram illustrating attachment of the transfer unit according to the first exemplary embodiment.

FIG. 8 is a schematic perspective diagram illustrating a state where attachment work of the transfer unit 8 with respect to the image forming apparatus 1 is started. When attachment work of the transfer unit 8 is executed, the user first holds the holding portions 11F and 11R arranged on the transfer unit 8 to insert the transfer unit 8 toward the apparatus main body. As illustrated in an enlarged view of a portion surrounded by a dashed line in FIG. 8, when the transfer unit 8 is being inserted, the cover 35F arranged on the leading end in the attaching direction of the transfer unit 8 comes into contact with a guiding portion 25 arranged on the apparatus main body. With this configuration, the leading end bosses 31F of the transfer unit 8 can be guided to the rail groove of the guiding rail 36, so that the transfer unit 8 can be prevented from being in contact with the photosensitive drums 6. In the present exemplary embodiment, the guiding portion 25 is configured of a cover member for covering a sensor 13 used for calibration, and has a portion that comes into contact with the transfer unit 8 at the end portion of the transfer unit 8 in the belt width direction.

Figure 9:
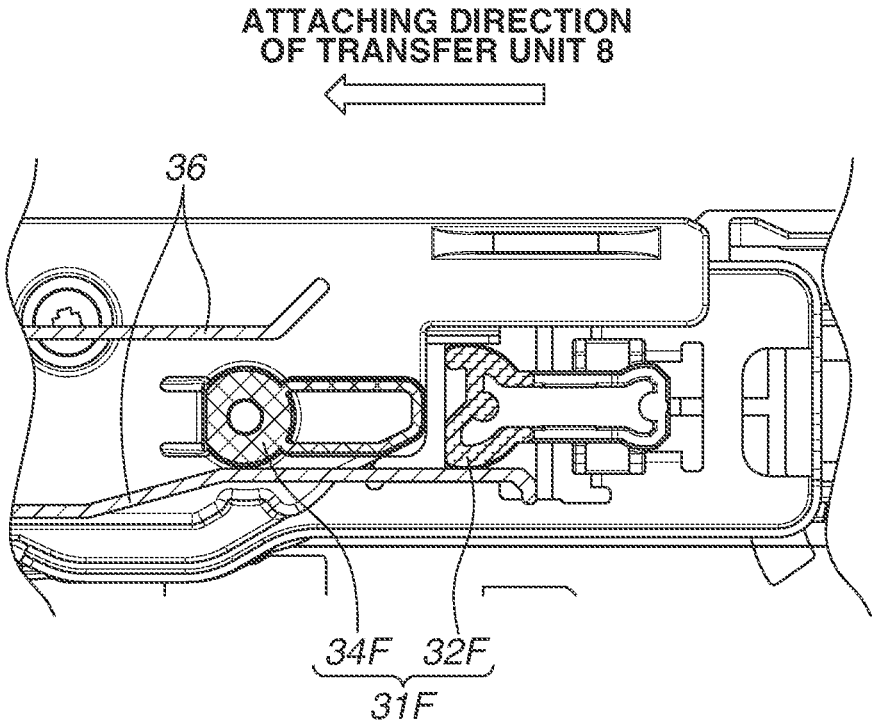
FIG. 9 is a schematic diagram illustrating a relationship between the guiding portion and the guiding rail when attachment work of the transfer unit according to the first exemplary embodiment is started.

FIG. 9 is a schematic cross-sectional diagram illustrating a state where the leading end bosses 31F are being guided toward the guiding rail 36 when attachment work of the transfer unit 8 is executed. When the transfer unit 8 is further inserted to the apparatus main body from the state illustrated in FIG. 8, the leading end bosses 31F are guided by the guiding rail 36 as illustrated in FIG. 9.

Figure 10:
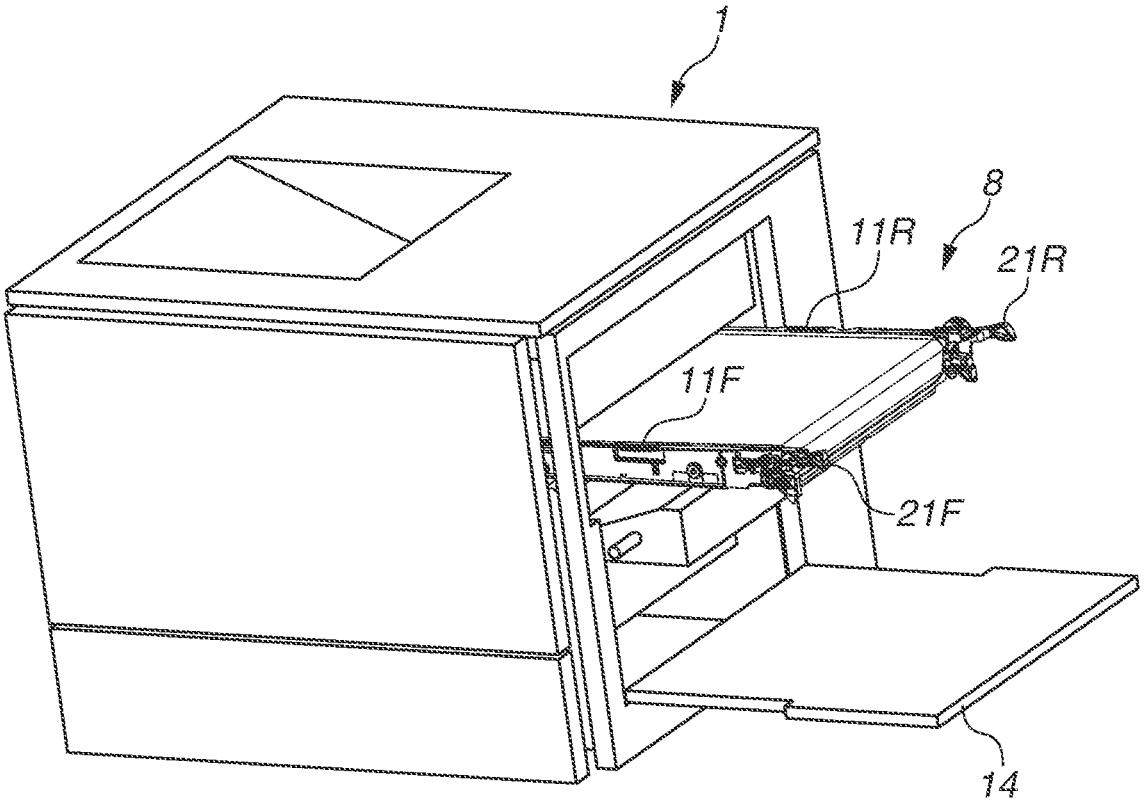
FIG. 10 is a schematic perspective diagram illustrating a state where attachment work of the transfer unit according to the first exemplary embodiment is executed halfway.

FIG. 10 is a schematic perspective diagram illustrating a state where the transfer unit 8 is further inserted from the state illustrated in FIG. 8. As illustrated in FIG. 10, when the transfer unit 8 is inserted until the holding portions 11F and 11R are inserted into the inner portion of the apparatus main body, it is difficult for the user to hold the holding portions 11F and 11R. At this time, the user can continuously hold the transfer unit 8 to execute the attachment work by holding the holding portions 21F and 21R instead of holding the holding portions 11F and 11R.

Figure 11:
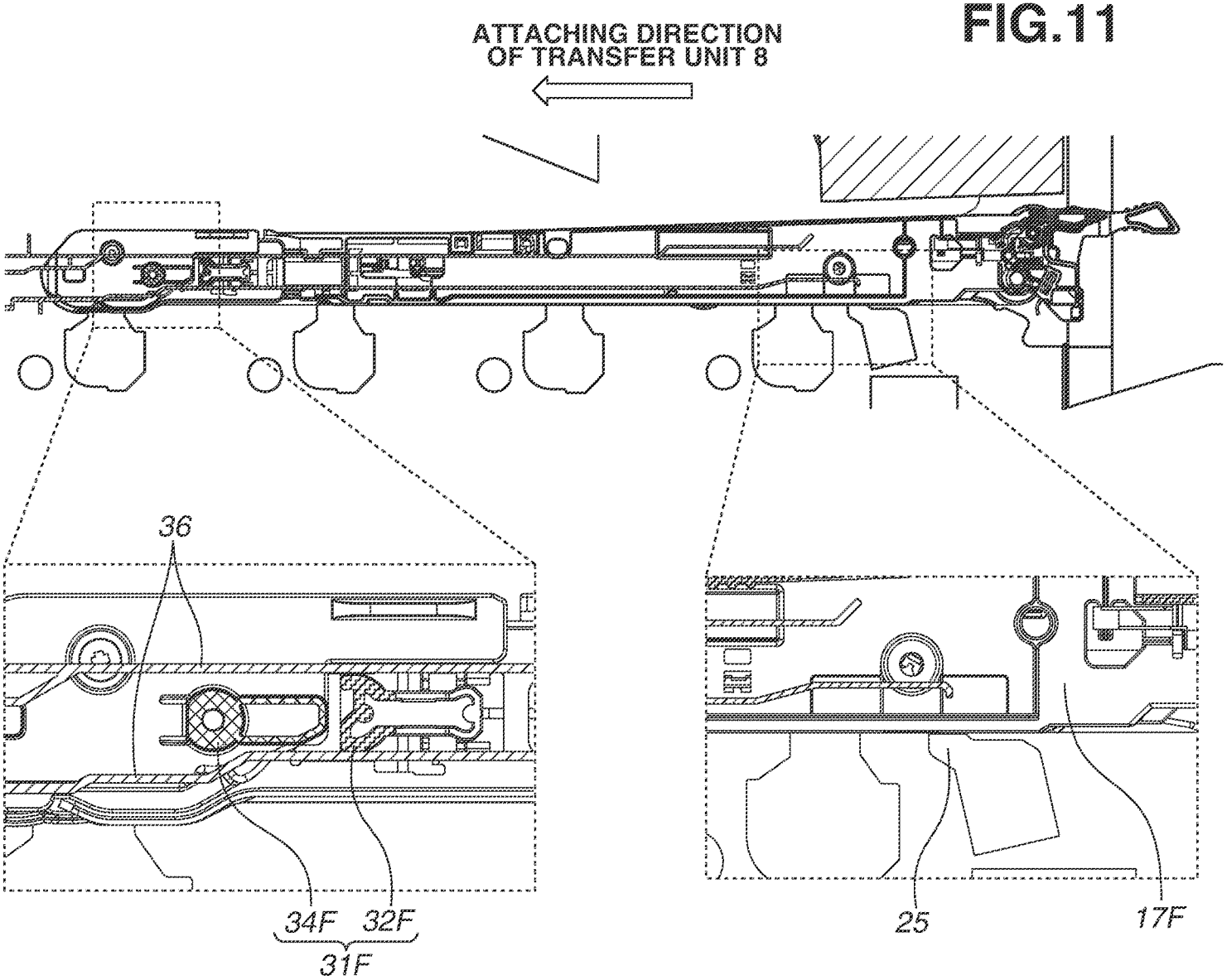
FIG. 11 is a schematic diagram illustrating a relationship between the guiding portion and the guiding rail when attachment work of the transfer unit according to the first exemplary embodiment is executed halfway.

FIG. 11 is a schematic cross-sectional diagram viewed in the rotation axis line direction of the driving roller 30, illustrating a state where the transfer unit 8 is further inserted from the state illustrated in FIG. 10. At this time, as illustrated in FIG. 11, on the downstream side (i.e., leading end side) in the attaching direction of the transfer unit 8, the leading end bosses 31F are guided by the guiding rail 36, so that the orientation of the transfer unit 8 on the leading end side is maintained. Further, on the upstream side (i.e., trailing end side) in the attaching direction of the transfer unit 8, the lower face in the vertical direction of the transfer frame 17F of the transfer unit 8 is in contact with the guiding portion 25 arranged on the apparatus main body, so that the orientation of the transfer unit 8 on the trailing end side is maintained.

Figure 12:
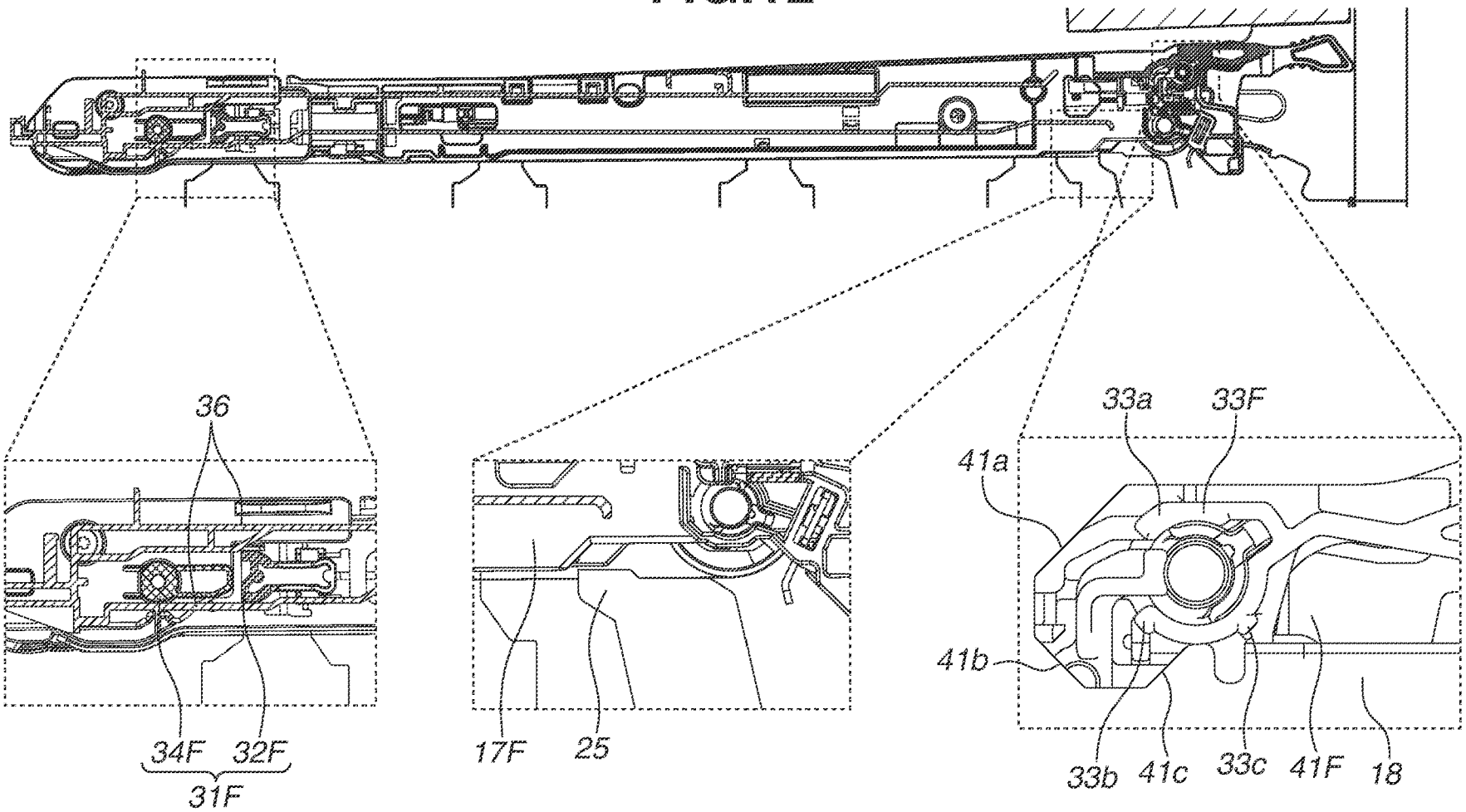
FIG. 12 is a schematic diagram illustrating a state of the transfer unit according to the first exemplary embodiment immediately before attachment work of the transfer unit is completed.

FIG. 12 is a schematic cross-sectional diagram viewed in the rotation axis line direction of the driving roller 30, illustrating a state immediately before attachment work of the transfer unit 8 is completed, where the transfer unit 8 is further inserted from the state illustrated in FIG. 11. At this time, similar to the state illustrated in FIG. 11, on the downstream side (i.e., leading end side) in the attaching direction of the transfer unit 8, the leading end bosses 31F are guided by the guiding rail 36, so that the orientation of the leading end of the transfer unit 8 is maintained. On the other hand, on the upstream side (i.e., trailing-end side) in the attaching direction of the transfer unit 8, the lower face of the transfer frame 17F of the transfer unit 8 is separated from the guiding portion 25 arranged on the apparatus main body. At this time, the boss 33F on the trailing end of the transfer unit 8 is in contact with the wall face of the cutout portion 41F arranged on the frame 18, so that the orientation of the trailing end of the transfer unit 8 is maintained.

As illustrated in FIGS. 6A and 6B, when attachment work of the transfer unit 8 is completed, the leading end bosses 31F arranged on the leading end in the attaching direction of the transfer unit 8 are held by the guiding rail 36. As a result, the leading end of the transfer unit 8 is positioned in the vertical direction by the guiding rail 36, so that orientation thereof is maintained.

Figure 13A:
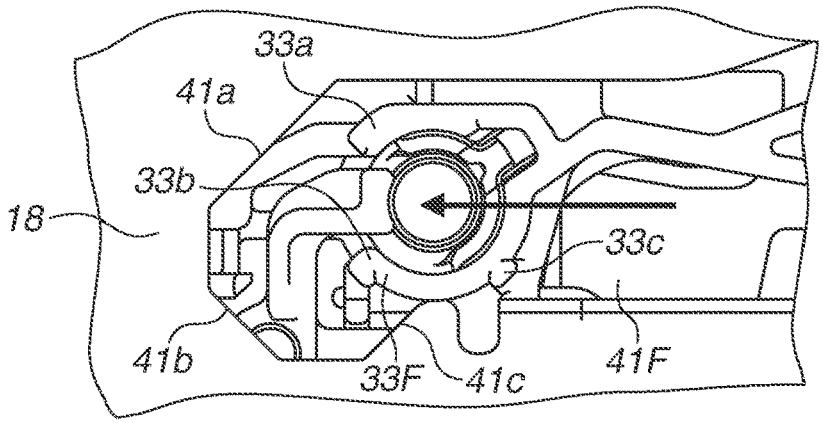
FIGS. 13A, 13B, and 13C are schematic diagrams illustrating relationships between the positioning portion and the abutting portion when attachment work of the transfer unit according to the first exemplary embodiment is being executed.
Figure 13B:
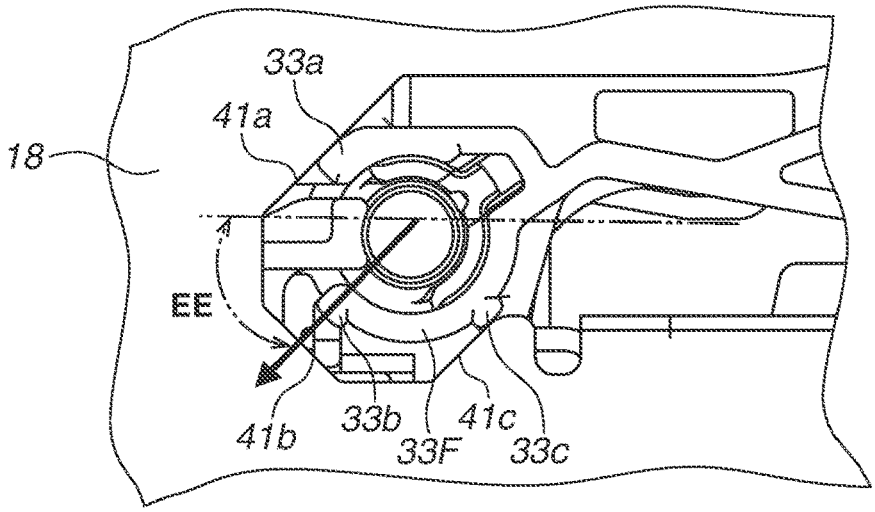
Figure 13C:
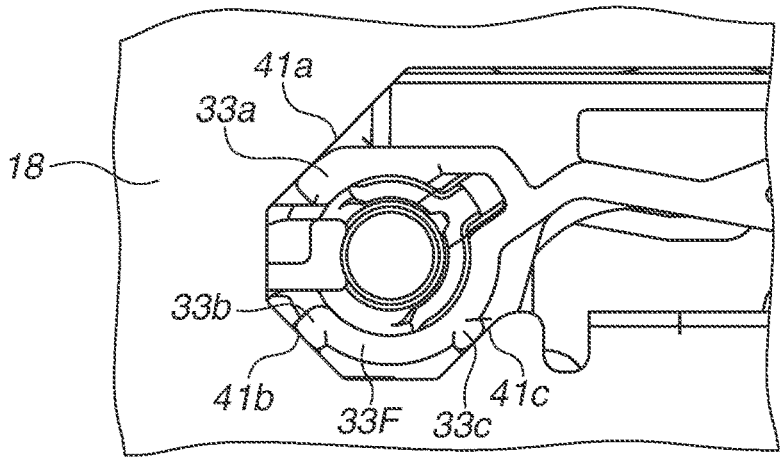

FIGS. 13A to 13C are schematic diagrams illustrating positioning of the trailing end in the attaching direction of the transfer unit 8. As illustrated in FIG. 13A, through insertion work of the transfer unit 8 in a direction indicated by an arrow in FIG. 13A, the boss 33F is first in contact with the wall face of the cutout portion 41F, so that the orientation of the lower end of the transfer unit 8 is maintained. Thereafter, when the insertion work of the transfer unit 8 is executed continuously, as illustrated in FIG. 13B, the boss 33 is guided along the shape of the cutout portion 41F and moved in an obliquely downward direction at an angle of 45 degrees (angle EE) from the previous insertion direction (i.e., horizontal direction).

More specifically, a facing portion 33*c* is arranged on the boss 33F, in addition to the abutting portions 33*a* and 33*b* which respectively abut on the abutting faces 41*a* and 41*b* when attachment work of the transfer unit 8 to the apparatus main body is completed. The facing portion 33*c* faces an inclined face 41*c* of the cutout portion 41F of the frame 18 with a minute space of approximately 0.1 mm when attachment work of the transfer unit 8 to the apparatus main body is completed. When the transfer unit 8 is being inserted, the facing portion 33*c* is moved along the shape of the inclined face 41*c* (inclined portion) while being in contact with the inclined face 41*c*, so that the boss 33F is moved obliquely downward in the vertical direction as illustrated in FIG. 13B.

The boss 33F is brought into a state illustrated in FIG. 13C when the boss 33F is moved downward in the vertical direction along the inclined face 41*c*. In the state illustrated in FIG. 13*c*, attachment work of the transfer unit 8 is almost completed, so that the user releases the holding portions 21F and 21R of the transfer unit 8 and closes the secondary transfer roller 10 and the door 14. As a result, the driving roller 30 receives the urging force from the secondary transfer roller 10, and the abutting portions 33*a* and 33*b* of the boss 33F arranged coaxially with the driving roller 30 are respectively urged toward the abutting faces 41*a* and 41*b* of the cutout portion 41F. As a result, the transfer unit 8 is positioned at a normal position for executing image formation, so that attachment work of the transfer unit 8 is completed.

In the configuration according to the present exemplary embodiment, each of the abutting faces 41*a* and 41*b* arranged on the frame 18 has a shape of an inclined face extending in a direction intersecting with the attaching direction of the transfer unit 8, and a space therebetween is increased toward the upstream side in the attaching direction. With this configuration, in a state where the transfer unit 8 is positioned at the normal position (i.e., a position where image formation is executed), positioning in the conveyance direction of the transfer material P (vertical direction) can be executed precisely. In other words, the urging force of the secondary transfer roller 10 causes the abutting portions 33*a* and 33*b* to be respectively pressed and in contact with the slope-shaped abutting faces 41*a* and 41*b*. As a result, a shift of the transfer unit 8 in the vertical direction can be suppressed when conveyance of the transfer material P is executed.

For example, in the conventional configuration discussed in the prior art documents, in which a transfer unit is positioned by guiding rails having horizontal faces arranged on the upper and lower sides in the vertical direction, it is necessary to provide a fit tolerance in the vertical direction in order to reduce friction occurring when insertion of the transfer unit is executed. In this a case, if force in the vertical direction is generated at the secondary transfer portion due to conveyance of a transfer material at the time of image formation, there is a possibility that the transfer unit is shifted in the vertical direction by the amount of fit tolerance. On the contrary, in the configuration according to the present exemplary embodiment, because the abutting faces 41*a* and 41*b* for positioning the transfer unit 8 in the vertical direction have shapes as illustrated in FIG. 13, positioning in the vertical direction, which is the conveyance direction of the transfer material, can be executed precisely while maintaining the attaching efficiency of the transfer unit 8.

Further, according to the configuration of the present exemplary embodiment, the transfer unit 8 is moved along the inclined face 41*c* in the obliquely downward direction immediately before attachment work of the transfer unit 8 is completed. With this movement, the user can confirm that the transfer unit 8 has been inserted to the normal position. In other words, through the downward movement of the transfer unit 8, the user can recognize the attachment completion position of the transfer unit 8, so that it is possible to prevent the user from stopping insertion work of the transfer unit 8 in the middle of attachment work. Further, before the transfer unit 8 is moved downward along the inclined face 41*c*, a track along which the transfer unit 8 is inserted extends in the horizontal direction. Therefore, it is possible to reduce the load applied to the transfer unit 8 in the course of insertion operation.

Further, in the present exemplary embodiment, a sloped-shape of the abutting face 41*a* has an angle substantially parallel to the angle (i.e., 45 degrees) at which the transfer unit 8 is moved in the oblique direction immediately before being attached to the normal position. In other words, the sloped-shape of the abutting face 41*a* is set to be substantially parallel to the sloped-shape of the inclined face 41*c*. With this configuration, when attachment/detachment work of the transfer unit 8 is executed, the boss 33F can be smoothly moved along the shape of the cutout portion 41F without interference.

Figure 21:
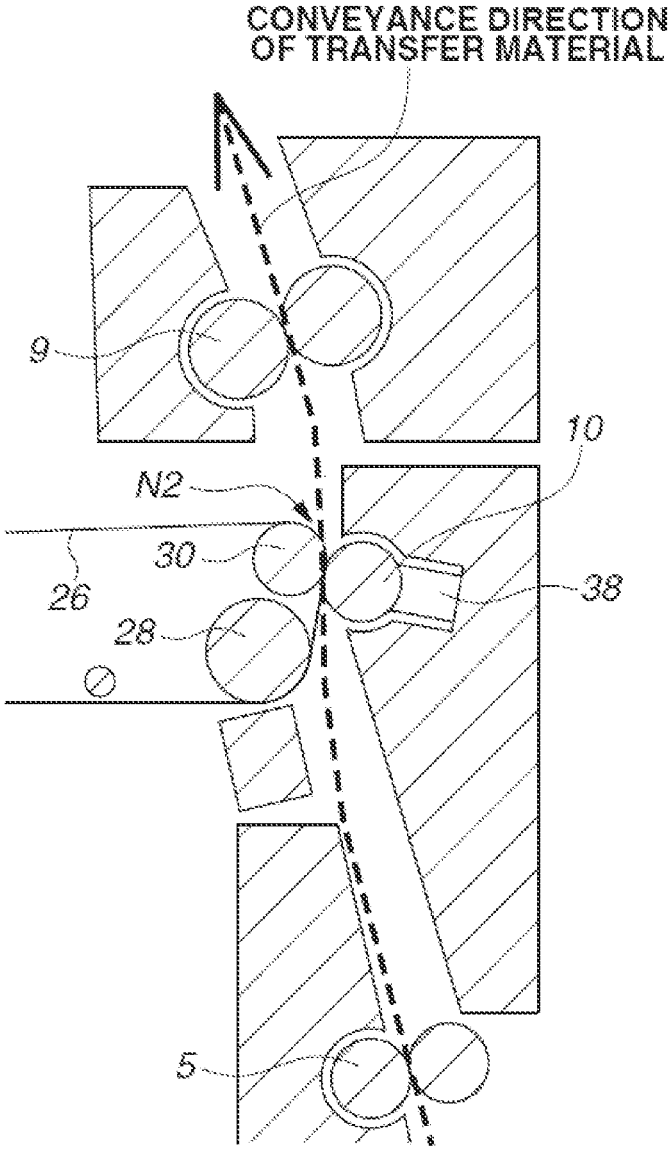
FIG. 21 is a schematic cross-sectional diagram illustrating a periphery of the secondary transfer portion of the image forming apparatus according to the first exemplary embodiment.
Figure 22:
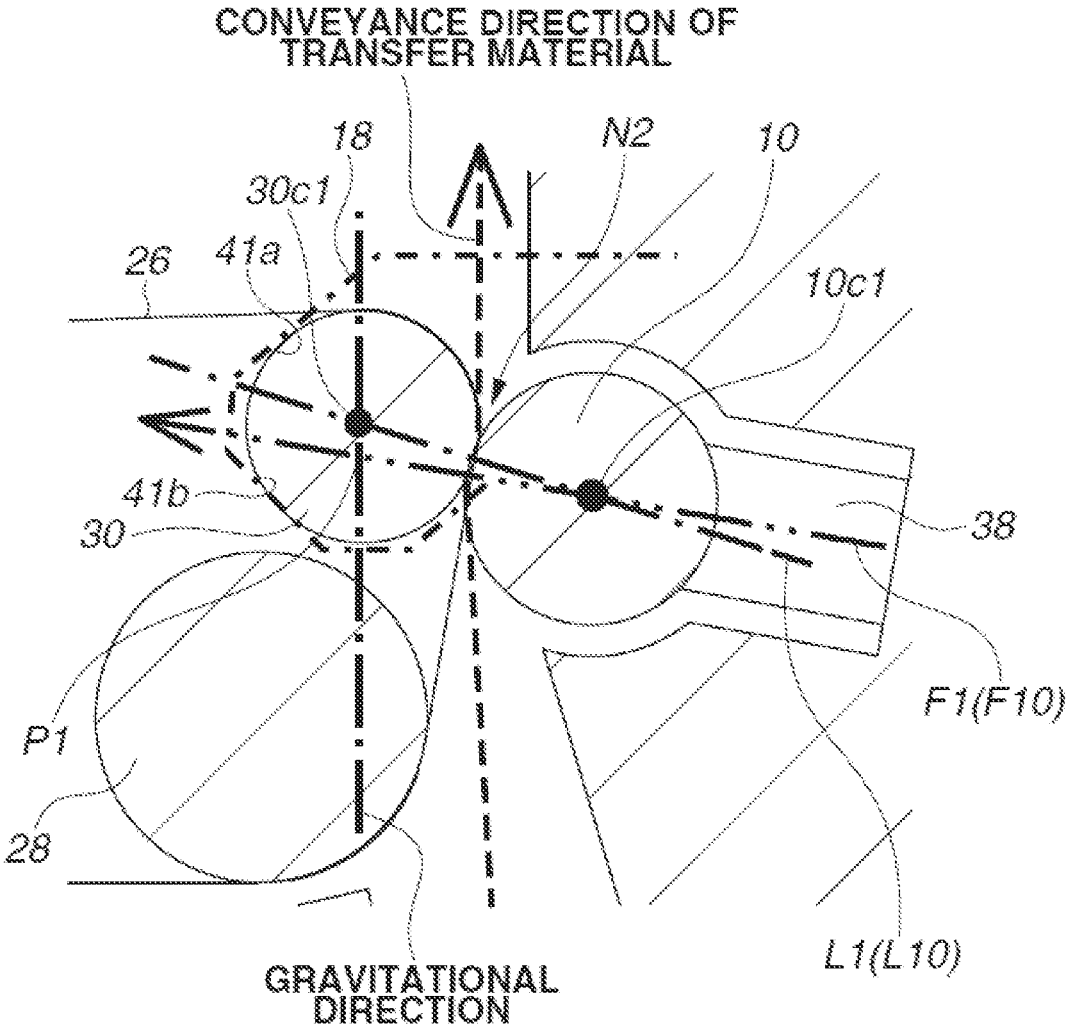
FIG. 22 is a diagram illustrating an enlarged view of a main portion illustrated in the schematic cross-sectional diagram in FIG. 21.

Further, FIG. 21 is a schematic cross-sectional diagram illustrating a periphery of the secondary transfer portion N2 of the image forming apparatus 1 according to the present exemplary embodiment. FIG. 22 is a diagram illustrating an enlarged view of a main portion illustrated in FIG. 21.

As illustrated in FIG. 21, the transfer material P conveyed by the conveyance roller 5 sequentially passes through the positions of the secondary transfer portion N2 (secondary transfer roller 10) and the fixing portion (fixing unit 9), so that a toner image on the intermediate transfer belt 26 is secondarily transferred and fixed to the transfer material P.

Further, at the secondary transfer portion N2, the secondary transfer roller 10 is urged in a predetermined direction indicated by an arrow F10 by the urging force F1 of the (urging) spring 38. FIG. 22 is an enlarged view illustrating the direction F10 in which the urging force F1 of the spring 38 is applied (urged).

As illustrated in FIG. 22, the urging direction F10 of the urging force F1 is a direction which follows an extending direction L10 of an imaginary straight line L1 that connects the rotation center 30*c*1 of the driving roller 30 and the rotation center 10*c*1 of the secondary transfer roller 10.

In the present exemplary embodiment, a state where the urging direction F10 "follows" the direction L10 corresponds to a state where the urging direction F10 is "identical to" the direction L10, or a state where an intersecting angle formed between the urging direction F10 and the direction L10 is 20 degrees or less.

Specifically, in the present exemplary embodiment, in the in-use orientation illustrated in FIG. 22, the urging direction F10 is set to follow the direction L10, as indicated by an arrow passing through the position of the rotation center 10*c*1 of the secondary transfer roller 10 and a position P1 located slightly below the rotation center 30*c*1 of the driving roller 30. For example, in the present exemplary embodiment, the intersecting angle formed between the urging direction F10 and the direction L10 can be 3 degrees.

Further, in the present exemplary embodiment, the urging direction F10 is described as a direction indicated by the arrow passing through the position P1 located below the position of the rotation center 30*c*1 of the driving roller 30. However, for example, the urging direction F10 of the urging force F1 caused by the spring 38 may be a direction heading toward an area occupied by the driving roller 30 when viewed in the rotation axis line direction of the driving roller 30. With this configuration, the transfer unit 8 (boss 33) can efficiently be urged (positioned) toward the positioning unit (the first abutting face 41*a* and the second abutting face 41*b*) by the urging force F1 of the spring 38.

A second exemplary embodiment will be described. An image forming apparatus according to the present exemplary embodiment includes a separation unit 27 which controls an abutting/separation state of the intermediate transfer belt 26 and the photosensitive drum 6. The separation unit 27 makes the secondary transfer roller 10 abut on or move away from the intermediate transfer belt 26 by moving the primary transfer roller 16. In addition, constituent elements and movement according the present exemplary embodiment are substantially similar to those described in the first exemplary embodiment except that the image forming apparatus includes the separation unit 27. Accordingly, in the below-described present exemplary embodiment, the same reference numerals are applied to the configurations and movement common to those of the first exemplary embodiment, and description thereof will be omitted. Further, a cross-sectional diagram which illustrates the overall configuration of the image forming apparatus of the present exemplary embodiment is approximately similar to FIG. 1 of the first exemplary embodiment.

In the image forming apparatus according to the present exemplary embodiment, only the black image forming unit SK is used when a black-and-white image is formed. In this case, the image forming unit SK forms a black toner image on the photosensitive drum 6K and acquires a black-and-white image by transferring the black toner image on the transfer material P via the intermediate transfer belt 26. On the other hand, when a full-color image is formed, all of the four image forming units SY, SM, SC, and SK are used. In this case, the image forming units SY, SM, SC, and SK form toner images of yellow, magenta, cyan, and black on the photosensitive drums 6Y, 6M, 6C, and 6K, and acquires a full-color image by sequentially transferring the toner images on the transfer material P via the intermediate transfer belt 26.

Further, according to the configuration described in the present exemplary embodiment, when a black-and-white image is formed, rotation of the photosensitive drums 6Y, 6M, and 6C is stopped in order to suppress wear on the surfaces of the photosensitive drums 6 which are not used for image formation. At this time, in order to prevent the photosensitive drums 6Y, 6M, and 6C from rubbing against the rotating intermediate transfer belt 26, the below-described separation unit 27 moves the primary transfer rollers 16Y, 16M, and 16C in a direction away from the photosensitive drums 6Y, 6M, and 6C. With this operation, the photosensitive drums 6Y, 6M, and 6C are separated from the intermediate transfer belt 26.

Further, if the primary transfer portions N1 are formed and maintained continuously when the image forming apparatus is in a stand-by state or a power-off state, there is a possibility that plastic deformation occurs in the primary transfer rollers 16 urged toward the photosensitive drums 6. When plastic deformation occurs in the primary transfer rollers 16, contact between the photosensitive drums 6 and the intermediate transfer belt 26 at the primary transfer portions N1 is degraded. This may cause transfer unevenness or an abnormal image to occur. In the present exemplary embodiment, in order to suppress the above-described deformation of the primary transfer rollers 16, the separation unit 27 described below moves all of the primary transfer rollers 16 in a direction away from the photosensitive drums 6 when the image forming apparatus is in a stand-by state or a power-off state. With this operation, all of the photosensitive drums 6 are separated from the intermediate transfer belt 26.

Figure 14:
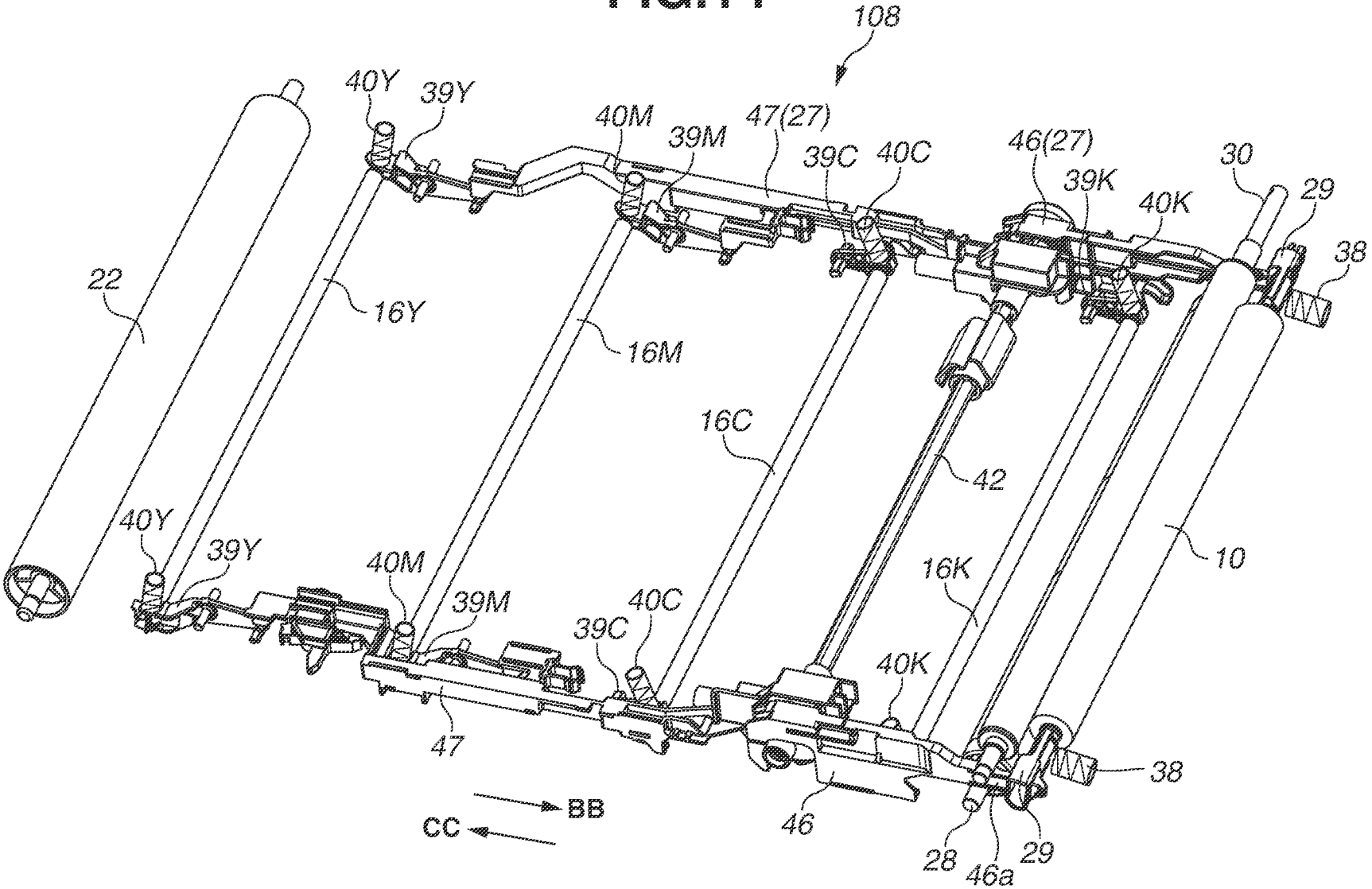
FIG. 14 is a schematic perspective diagram illustrating a configuration of a separation unit according to a second exemplary embodiment.

FIG. 14 is a schematic diagram illustrating a configuration of a transfer unit 108 according to the present exemplary embodiment. In FIG. 14, in order to illustrate the inner structure of the transfer unit 108, illustrations of transfer frames and an intermediate transfer belt of the transfer unit 108 are omitted. Herein, although illustrations of the transfer frames and the intermediate transfer belt are omitted, configurations of the transfer frames are substantially similar to the configurations of the transfer frames 17F and 17R in the first exemplary embodiment, and the configuration of the intermediate transfer belt is substantially similar to the intermediate transfer belt 26 in the first exemplary embodiment. As illustrated in FIG. 14, abutting or separation of the photosensitive drums 6 with respect to the intermediate transfer belt 26, which is caused by the movement of the primary transfer rollers 16, is executed by rotationally moving the rotation portion 52 arranged at a position between the primary transfer roller 16C and the primary transfer roller 16K. The rotation portion 52 and the separation unit 27 will be described below in detail.

A toner image is secondarily transferred to the transfer material P at the secondary transfer portion N2 (see FIG. 1) formed by the driving roller 30 and the secondary transfer roller 10 facing each other via the intermediate transfer belt 26. As illustrated in FIG. 14, the secondary transfer roller 10 is rotatably supported by shaft bearings 29 at both end portions of the rotation shaft. Each of the shaft bearings 29 is urged by a spring 38 serving as an urging member, and the secondary transfer roller 10 is pressed toward the driving roller 30 via the intermediate transfer belt 26 by the urging force of the spring 38, so that the secondary transfer portion N2 is formed.

If there is a space at the secondary transfer portion N2, abnormal electrical discharge will occur. Thus, in order to enhance the contact between the intermediate transfer belt 26 and the secondary transfer roller 10, comparatively strong force is set as the urging force of the spring 38 serving as the urging member for the secondary transfer roller 10. In the present exemplary embodiment, the urging force of the springs 38 on both sides is set to 50N in total.

Herein, if the secondary transfer roller 10 is left to stand in a state urged toward the driving roller 30 for a long time by the springs 38 having comparatively strong urging force, there is a possibility that the intermediate transfer belt 26 may be permanently curled up at the secondary transfer portion N2 due to the urging force received from the secondary transfer roller 10. If the intermediate transfer belt 26 is curled up permanently, contact between the photosensitive drum 6 and the intermediate transfer belt 26 at the primary transfer portion N1 and contact between the intermediate transfer belt 26 and the secondary transfer roller 10 at the secondary transfer portion N2 will be degraded, so that transfer unevenness or an abnormal image will occur. Therefore, in order to prevent the intermediate transfer belt 26 from being curled up permanently, in the configuration according to the present exemplary embodiment, the separation unit 27 which causes the secondary transfer roller 10 to abut on or to move away from the intermediate transfer belt 26 is arranged. The separation unit 27 will be described below in detail.

<Separation Unit>

Figure 15:
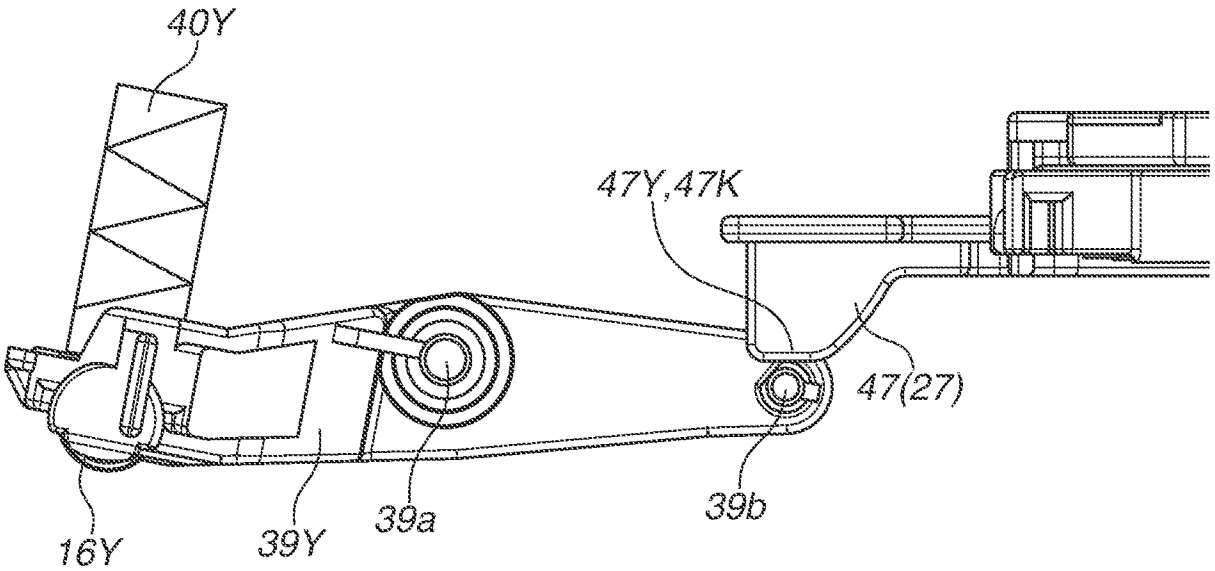
FIG. 15 is a schematic diagram illustrating a separation structure of a primary transfer roller according to the second exemplary embodiment.
Figure 16:
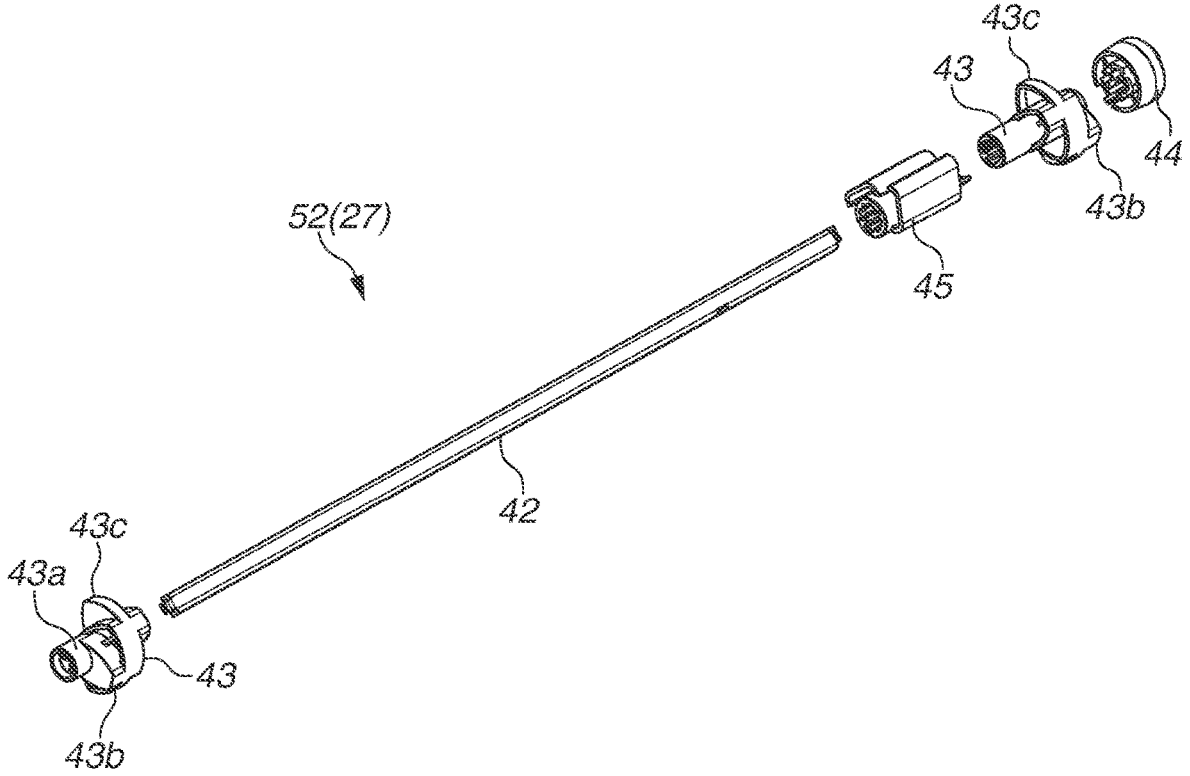
FIG. 16 is a schematic diagram illustrating a configuration of a rotation portion of the separation unit according to the second exemplary embodiment.

Next, the separation unit 27 according to the present exemplary embodiment will be described with reference to FIGS. 14 to 16. FIG. 15 is a schematic diagram illustrating a configuration of a primary transfer shaft bearing 39Y which supports an end portion of the primary transfer roller 16Y. FIG. 16 is a schematic exploded perspective view illustrating respective components constituting the rotation portion 52 detached from a separation shaft 42.

As illustrated in FIG. 14, the primary transfer rollers 16 (16Y, 16M, 16C, and 16K) are rotatably held by the primary transfer shaft bearings 39 (i.e., shaft bearings 39Y, 39M, 39C, and 39K) at both shaft end portions. Each of the primary transfer rollers 16 forms a primary transfer portion N1 by pressing the photosensitive drum 6 with springs 40 (40Y, 40M, 40C, and 40K), which are urging members, via the intermediate transfer belt 26. A configuration for supporting each of the primary transfer rollers 16 will be described by using the primary transfer roller 16Y. As illustrated in FIG. 15, a shaft bearing 39Y that supports the primary transfer roller 16Y includes a rotation fulcrum point 39*a* and a hook 39*b*. The rotation fulcrum point 39*a* is retained by the transfer frame in a freely-rotatable state.

In the present exemplary embodiment, the shaft bearings 39Y and 39M which respectively support the primary transfer rollers 16Y and 16M have the same shaft bearing structure, and the shaft bearings 39C and 39K which respectively support the primary transfer rollers 16C and 16K have the same shaft bearing structure. By partially using the common components, the number of types of components can be reduced. Further, the shaft bearings 39C and 39K are substantially similar to the shaft bearings 39Y and 39M except for the shapes. Similar to the shaft bearings 39Y and 39M, the shaft bearings 39C and 39K also have the rotation fulcrum points and hooks.

The separation unit 27 according to the present exemplary embodiment includes the rotation portion 52 and sliders 46 and 47. As illustrated in FIG. 16, the rotation portion 52 includes a separation shaft 42, separation cams 43, a shaft coupling 44, and a damper 45. The separation shaft 42 is formed of a sheet metal bent into a squared U-shape, and the separation cams 43, the damper 45, and the shaft coupling 44 are respectively fixed to the separation shaft 42. Each of the separation cams 43 is arranged on each end portion in the axis direction of the separation shaft 42. A boss 43*a* arranged on the separation cam 43 fits into a hole (not illustrated) formed on the transfer frame, and an outer circumferential face of the shaft coupling 44 fits into a hole (not illustrated) formed on the transfer frame, so that the rotation portion 52 is rotatably retained with respect to the transfer unit 108.

The rotation portion 52 rotates by receiving power transmitted to the shaft coupling 44 from a driving power source (not illustrated) arranged on the apparatus main body of the image forming apparatus. The damper 45 is in contact with the transfer frame at a certain rotation phase of the rotation portion 52 to deform elastically, so as to function as a brake which prevents the rotation portion 52 from being rotated swiftly. As illustrated in FIG. 16, the separation cam 43 is integrally configured of a cam portion 43*b* (first cam) and a cam portion 43*c* (second cam) having different phases.

As illustrated in FIG. 14, sliders 46 (first sliders) and sliders 47 (second sliders) are arranged in the vicinities of the shaft bearings 39Y, 39M, 39C, and 39K, so as to be slidable within the transfer frames. Each of the sliders 46 is engaged with the cam portion 43*b* and reciprocally moves in a direction BB and a direction CC indicated by arrows in FIG. 14 in accordance with the rotation of the cam portion 43*b*. Further, each of the sliders 47 is engaged with the cam portion 43*c* and reciprocally moves in the direction BB and the direction CC indicated by the arrows in FIG. 14 in accordance with the rotation of the cam portion 43*c*. It is preferable that a resinous material having an excellent sliding property be used for the separation cam 43 and the sliders 46 and 47. In the present exemplary embodiment, polyacetal (POM) resin is used as the material. The sliders 46 and 47 are arranged in an area on the inner side of the inner circumferential face of the intermediate transfer belt 26 in the vertical direction without protruding from the upper and the lower faces of the intermediate transfer belt 26 stretched around the three stretching rollers.

In conjunction with reciprocal movement thereof, the sliders 47 can make the primary transfer rollers 16Y, 16M, and 16C move against the urging force of springs 40. More specifically, each of the sliders 47 includes abutting faces 47Y, 47M, and 47C capable of abutting on the hooks 39*b* arranged on the shaft bearings 39Y, 39M, and 39C. Then, through the reciprocal movement in accordance with the rotation of the rotation portion 52, the sliders 47 can make the primary transfer rollers 16Y, 16M, and 16C move by changing the contact states of the abutting faces 47Y, 47M and 47C with respect to the hooks 39*b*.

In conjunction with reciprocal movement thereof, the sliders 46 can make the primary transfer roller 16K move against the urging force of spring 40. More specifically, each of the sliders 46 includes an abutting face 46K capable of abutting on the hook 39*b* arranged on the shaft bearing 39K. Then, through the reciprocal movement in accordance with the rotation of the rotation portion 52, the sliders 46 can make the primary transfer roller 16K move by changing the contact state of the abutting face 46K with respect to the hook 39*b*.

Each of the sliders 46 further includes an arm 46*a* which makes the secondary transfer roller 10 separate from the intermediate transfer belt 26 by moving against the urging force of the spring 38 through the movement of the slider 46. As illustrated in FIG. 14, the arm 46*a* is arranged at a position between a cored bar of the driving roller 30 and a cored bar of the driven roller 28 in the vertical direction, and projected to a side of the secondary transfer roller 10 in the moving direction of the slider 46.

Figure 17:
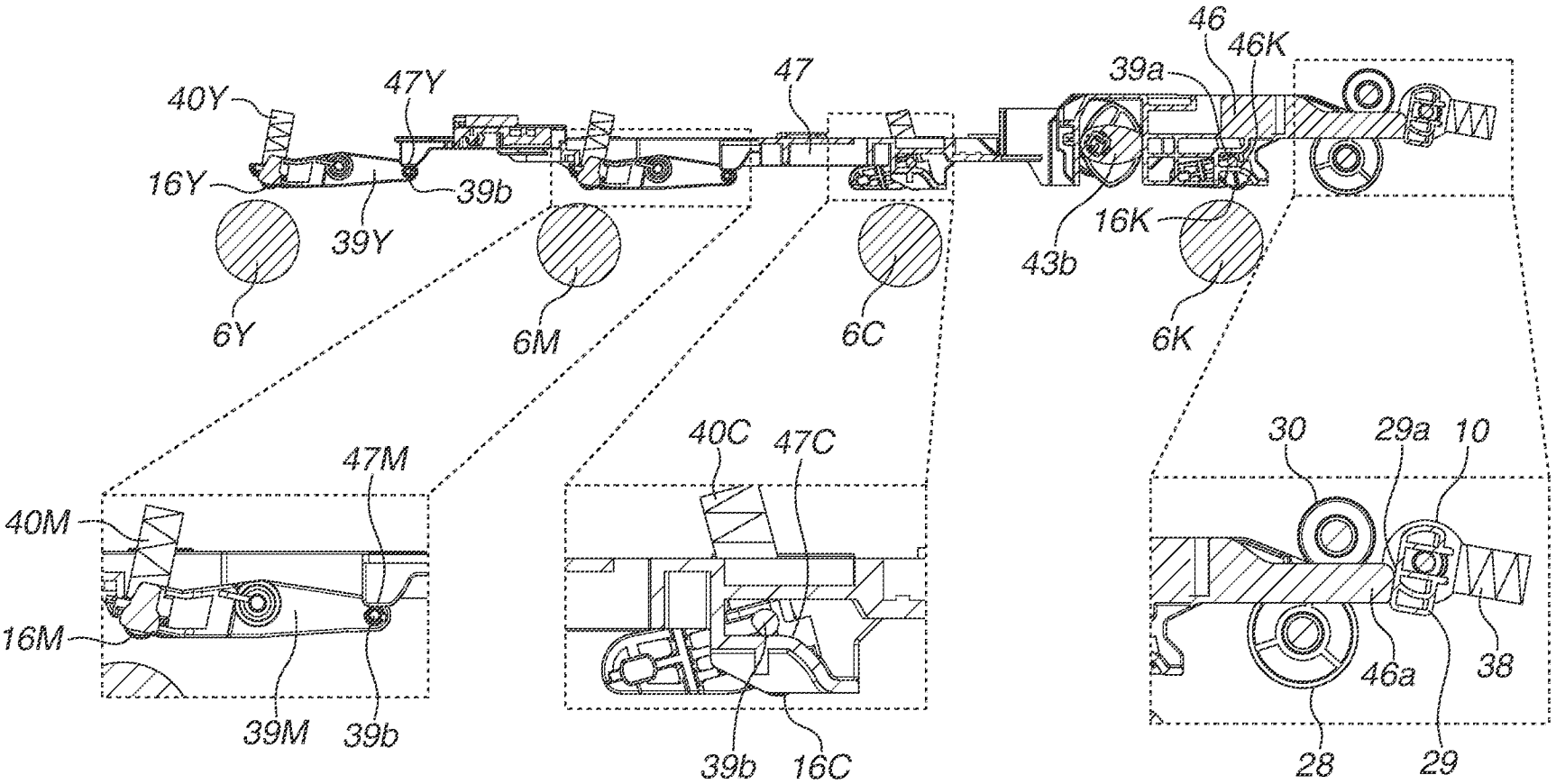
FIG. 17 is a schematic diagram illustrating the states of the primary transfer roller and the secondary transfer roller when the image forming apparatus is in a stand-by state or a power-off state according to the second exemplary embodiment.
Figure 18:
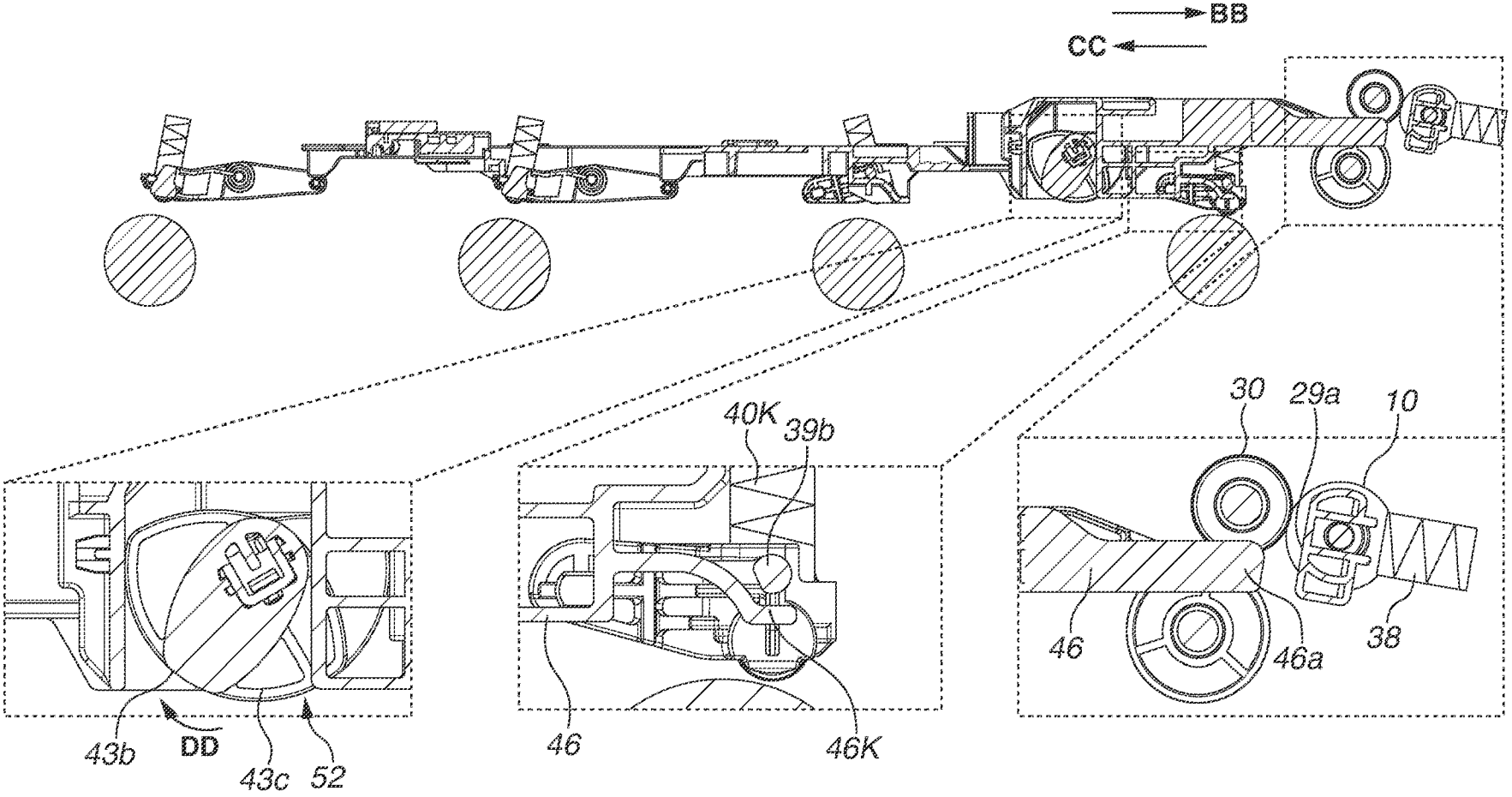
FIG. 18 is a schematic diagram illustrating the states of the primary transfer roller and the secondary transfer roller according to the second exemplary embodiment when black-and-white image formation is executed.
Figure 19:
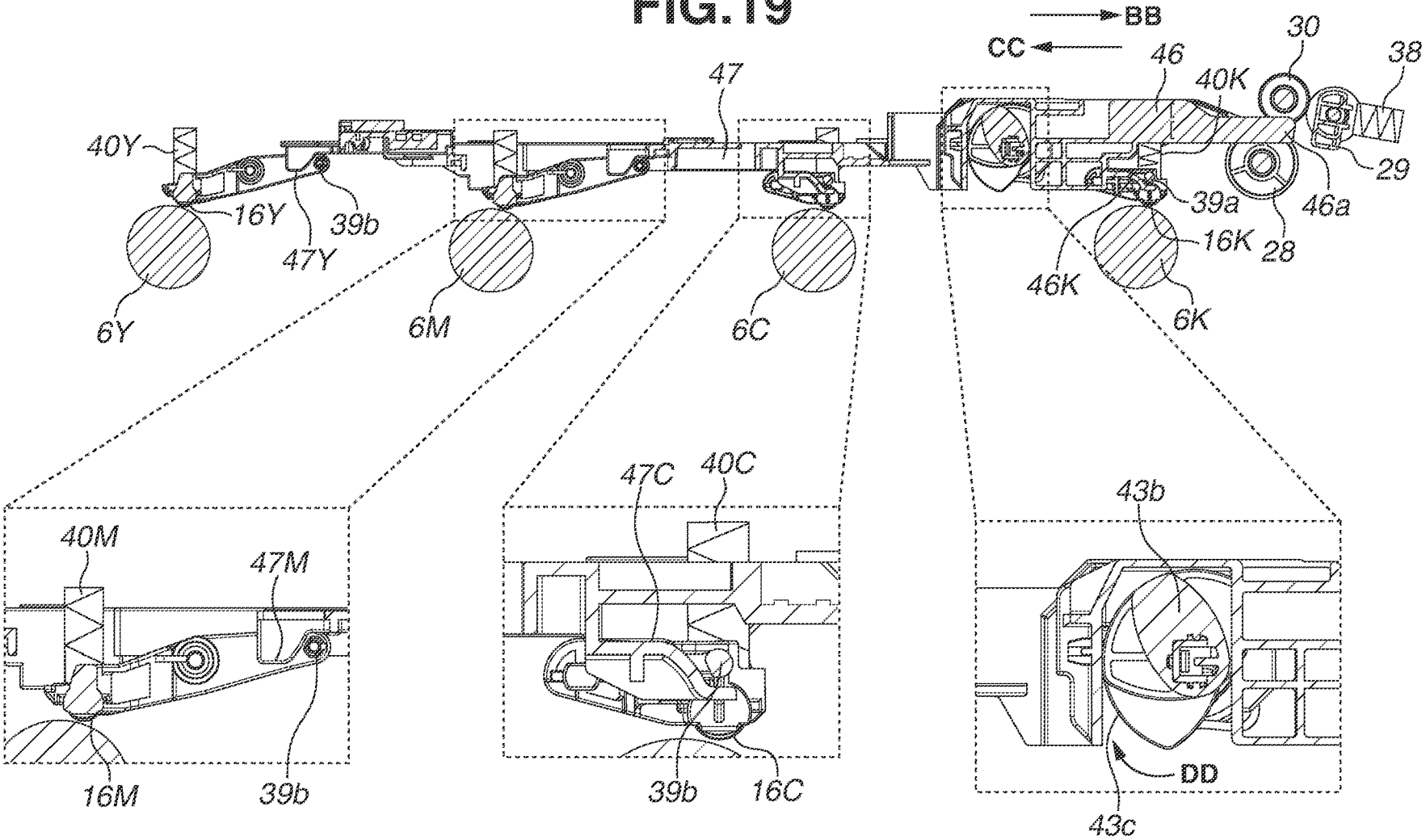
FIG. 19 is a schematic diagram illustrating the states of the primary transfer roller and the secondary transfer roller according to the second exemplary embodiment when full-color image formation is executed.

FIG. 17 is a schematic diagram illustrating the states (fully-separated states) of the primary transfer rollers 16 and the secondary transfer roller 10 when the image forming apparatus is in a stand-by state or a power-off state. FIG. 18 is a schematic diagram illustrating states of the primary transfer rollers 16 and the secondary transfer roller 10 when black-and-white image formation is executed (i.e., black-and-white mode abutting state). Further, FIG. 19 is a schematic diagram illustrating states of the primary transfer rollers 16 and the secondary transfer roller 10 when full-color image formation is executed (i.e., full-color mode abutting state).

As illustrated in FIG. 17, when the image forming apparatus is in a stand-by state or a power-off state, the hooks 39*b* of the shaft bearings 39 of the primary transfer rollers 16 respectively abut on the abutting faces 47Y, 47M, 47C, and 46K of the sliders 47 and 46. In other words, the hooks 39*b* abut on the abutting faces 47Y, 47M, 47C, and 46K for respective colors. With this configuration, as illustrated in FIG. 17, each of the primary transfer rollers 16 is moved against the urging force of the springs 40 and located at a separation position separated from the photosensitive drum 6. As a result, each of the photosensitive drums 6 is separated from the intermediate transfer belt 26.

Further, as illustrated in FIG. 17, when the image forming apparatus is in a stand-by state or a power-off state, the arm 46*a* of the slider 46 abuts on a pressing face 29*a* of the shaft bearing 29 to press the shaft bearing 29 of the secondary transfer roller 10 against the urging force of the spring 38. As a result, the secondary transfer roller 10 is separated from the intermediate transfer belt 26. As described above, when the image forming apparatus is in a stand-by state or a power-off state, the photosensitive drums 6 and the secondary transfer roller 10 are separated from the intermediate transfer belt 26. This state is called "fully-separated state".

Herein, each of the springs 38 presses the area where the cored bar of the secondary transfer roller 10 fits into the shaft bearing 29. In the present exemplary embodiment, as illustrated in FIG. 17, the spring 38, the shaft bearing 29, the arm 46*a*, and the cam portion 43*b* are arranged on substantially the same straight line. In other words, the spring 38, the shaft bearing 29, the arm 46*a* and the cam portion 43*b*, arranged on each end portion in the belt width direction, are arrayed on substantially the same straight line in the moving direction of the slider 46. Therefore, moment of force caused by the spring 38 is less likely to act on the slider 46 and the arm 46*a*.

When the image forming apparatus receives a printing signal for forming a black-and-white image, as illustrated in FIG. 18, the rotation portion 52 is rotated by 120 degrees in a direction DD indicated by an arrow in FIG. 18 from the fully-separated state illustrated in FIG. 17. Due to the above rotation, the slider 46 is moved by the cam portion 43*b* in a direction CC indicated by an arrow in FIG. 18. At this time, even when the rotation portion 52 is rotated by 120 degrees, the cam portion 43*c* and the slider 47 remain in the engaged state. Thus, the slider 47 does not move in the direction CC.

When the slider 46 moves in the direction CC in FIG. 18, the hook 39*b* arranged on the shaft bearing 39K of the primary transfer roller 16K and the abutting face 46K are brought into a separation state from an abutting state. As a result, the primary transfer roller 16K is moved to a position where the primary transfer roller 16K urges the intermediate transfer belt 26 toward the photosensitive drum 6K with the urging force of the spring 40, so that the intermediate transfer belt 26 abuts on the photosensitive drum 6K to form the primary transfer portion N1K. Further, when the slider 46 is moved in the direction CC in FIG. 18, the arm 46*a* and the pressing face 29*a* are brought into a separation state from an abutting state. Therefore, the secondary transfer roller 10 is moved to a position where the secondary transfer roller 10 abuts on the intermediate transfer belt 26 by the urging force of the spring 38 and presses the driving roller 30 via the intermediate transfer belt 26, so that the secondary transfer portion N2 is formed.

As described above, when black-and-white image formation is executed, the photosensitive drum 6K and the secondary transfer roller 10 respectively abut on the intermediate transfer belt 26. This state is called "black-and-white mode abutting state". After the primary transfer processing and secondary transfer processing of black-and-white image formation are finished, the slider 46 can be moved in the direction BB indicated by the arrow in FIG. 14 by rotating the rotation portion 52 by 240 degrees in the direction DD indicated by the arrow in FIG. 18 at a predetermined timing. Through the above movement, the abutting face 46K abuts on the hook 39*b* of the shaft bearing 39K, and the arm 46*a* abuts on the pressing face 29*a*, so that it is possible to achieve the fully-separated state illustrated in FIG. 17.

When the image forming apparatus receives a printing signal for forming a full-color image, as illustrated in FIG. 19, the rotation portion 52 is rotated by 240 degrees in a direction DD indicated by an arrow in FIG. 19 from the fully-separated state illustrated in FIG. 17. Due to the above rotation, the slider 47 is moved by the cam portion 43*c* in a direction CC indicated by an arrow in FIG. 19.

When the slider 47 moves in the direction CC in FIG. 19, the hooks 39*b* arranged on the shaft bearings 39Y, 39M, and 39C of the primary transfer rollers 16Y, 16M, and 16C and the abutting faces 47Y, 47M, and 47C are respectively brought into a separation state from an abutting state. Accordingly, the primary transfer rollers 16Y, 16M, and 16C are respectively moved to positions where the primary transfer rollers 16Y, 16M, and 16C urge the intermediate transfer belt 26 toward the photosensitive drums 6Y, 6M, and 6C with the urging force of the springs 40Y, 40M, and 40C. As a result, the intermediate transfer belt 26 abuts on the photosensitive drums 6Y, 6M, and 6C, so that the primary transfer portions N1Y, N1M, and N1C are formed.

Further, as described above, when the slider 46 is moved in the direction CC indicated by the arrow in FIG. 19, the photosensitive drum 6K abuts on the intermediate transfer belt 26 to form the primary transfer portion N1K, and the secondary transfer roller 10 abuts on the intermediate transfer belt 26 to form the secondary transfer portion N2. As described above, when full-color image formation is executed, the photosensitive drums 6 and the secondary transfer roller 10 respectively abut on the intermediate transfer belt 26. This state is called "full-color mode abutting state".

After the primary transfer processing and secondary transfer processing of full-color image formation are finished, the sliders 46 and 47 can be moved in the direction BB indicated by the arrow in FIG. 19 by rotating the rotation portion 52 by 120 degrees in the direction DD indicated by the arrow in FIG. 19 at a predetermined timing. Through the above movement, the abutting faces 47K, 47M, 47C, and 46K respectively abut on the hooks 39*b* of the shaft bearings 39Y, 39M, 39C, and 39K, and the arm 46*a* abuts on the pressing face 29*a*, so that it is possible to achieve the fully-separated state illustrated in FIG. 17.

As described above, in the configuration according to the present exemplary embodiment, abutting/separation control of the primary transfer roller 16 and the secondary transfer roller 10 is executed by the separation unit 27 arranged on the inner portion of the transfer unit 108. With this configuration, in a state where the secondary transfer roller 10 abuts on the intermediate transfer belt 26, urging force can be applied to the transfer unit 108 by applying urging force to the driving roller 30 from the spring 38 via the secondary transfer roller 10. Further, as illustrated in FIG. 17, in a state where the secondary transfer roller 10 is separated from the intermediate transfer belt 26, the slider 46 arranged on the transfer unit 108 is urged by the spring 38 via the shaft bearing 29, so that the urging force of the spring 38 can be applied to the transfer unit 108.

In other words, through the configuration according to the present exemplary embodiment, in a state where the transfer unit 108 is attached to the image forming apparatus, the urging force of the spring 38 can be applied to the transfer unit 108 regardless of whether the secondary transfer roller 10 is in the abutting state or the separation state. Accordingly, in addition to acquiring the effect described in the first exemplary embodiment, the transfer unit 108 can constantly be positioned to the normal position by constantly applying the urging force the transfer unit 108 regardless of whether the secondary transfer roller 10 is in the abutting state or the separation state.

Figure 20:
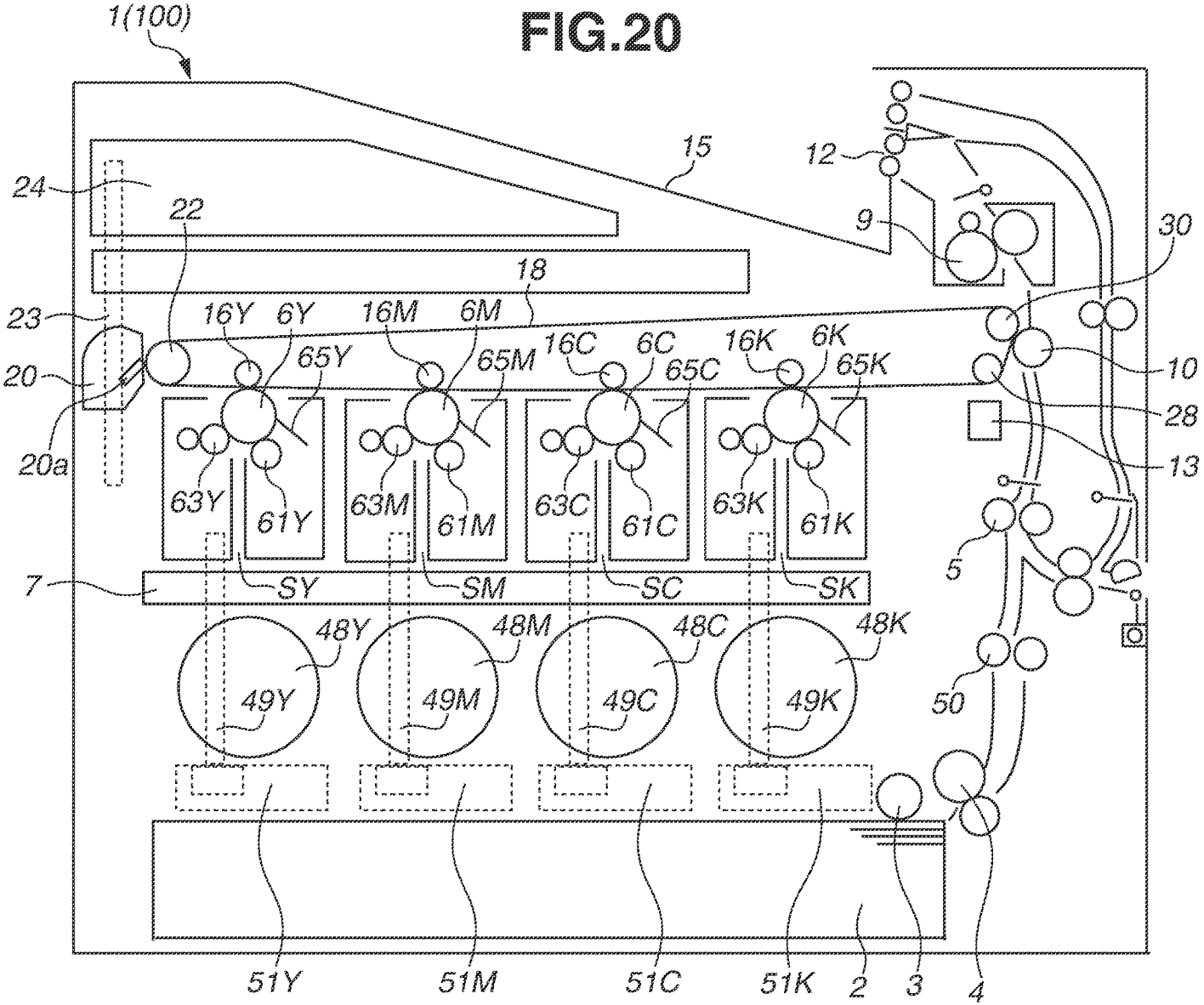
FIG. 20 is a schematic cross-sectional diagram illustrating a configuration of an image forming apparatus according to a third exemplary embodiment.

A third exemplary embodiment will be described. FIG. 20 is a schematic diagram illustrating a configuration of an image forming apparatus 100 according to the present exemplary embodiment. As illustrated in FIG. 20, the image forming apparatus 100 according to the present exemplary embodiment is an intermediate-transfer color image forming apparatus employing an electrophotographic method. Hereinafter, the present exemplary embodiment will be described with reference to FIG. 20. In the below-described present exemplary embodiment, same reference numerals are applied to the configurations common to those described in the first exemplary embodiment, and description thereof will be omitted.

Toner replenishing containers 48Y, 48M, 48C, and 48K are arranged in a substantially horizontal state at a position between the exposure unit (scanner unit) 7 and the sheet-feeding cassette 2 on the lower side of the image forming unit. Replenishment toner of corresponding colors are charged inside the toner replenishing containers 48. Depending on the consumption amount of toner within the image forming unit, each of toner conveyance devices 49Y, 49M, 49C, and 49K conveys toner received from the toner replenishing container 48 to the upper side, and supplies toner to the development device. The toner conveyance devices 49 are driven by toner conveyance driving devices 51Y, 51M, 51C, and 51K arranged under the toner conveyance devices 49.

In the above-described configuration for replenishing toner, a distance from the sheet-feeding cassette 2 to the secondary transfer portion is longer because the toner replenishing containers 48 are arranged on the upper side of the sheet-feeding cassette 2. Thus, compared to the configuration which does not use toner replenishing containers, a transfer material having a smaller size cannot be conveyed unless the conveyance roller 50 is arranged additionally. If the number of rollers for conveying the transfer material is increased, there is a high possibility that respective rollers have negative effects caused by deviation of conveyance speed, or that force of pushing or pulling the transfer material P is generated at the secondary transfer portion N2.

By employing the positioning method and the replacing method of the transfer unit 8 described in the first exemplary embodiment in the configuration of the image forming apparatus 100 according to the present exemplary embodiment, it is possible to obtain an effect similar to the effect of the first exemplary embodiment.

In an example, a transfer unit of an image forming apparatus includes bosses arranged on an axis line same as that of a driving roller, and a frame includes a first abutting face and a second abutting face which position the transfer unit by abutting on the bosses. When viewed in a rotation axis line direction of the driving roller, the second abutting face is arranged upstream of the first abutting face in a conveyance direction of a transfer material. Further, the first abutting face and the second abutting face are faces extending in a direction intersecting with the conveyance direction of the transfer material, which are arranged so that a space between the first and the second abutting faces is increased toward the upstream side in an attaching direction of the transfer unit. According to an aspect of the present disclosure, it is possible to position a transfer unit precisely when image formation is being executed by an image forming apparatus having a transfer unit capable of being attached or detached in a direction intersecting with a face where a toner image is transferred to a transfer material.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2020-113356, filed Jun. 30, 2020, and No. 2021-075140, filed Apr. 27, 2021, which are hereby incorporated by reference herein in their entirety.

What is claimed is:

1. An image forming apparatus comprising:

an image bearing member configured to bear a toner image;

a transfer unit including an endless belt, a plurality of stretching members that is rotatable, and a primary transfer member, wherein the endless belt is stretched around the plurality of stretching members, is configured to rotationally-move, and is capable of touching with the image bearing member, and wherein the primary transfer member is arranged on an inner circumferential face side of the endless belt and is configured to transfer the toner image borne on the image bearing member to the endless belt;

a positioning unit configured to position the transfer unit;

a secondary transfer member in touch with the endless belt to form a secondary transfer portion, wherein, in a case where the toner image is transferred to the endless belt from the image bearing member, the secondary transfer member is configured to transfer the toner image from the endless belt at the secondary transfer portion to a transfer material; and an urging member configured to urge the secondary transfer member toward a facing member, wherein the facing member is one of the plurality of stretching members and is arranged at a position facing the secondary transfer member via the endless belt, wherein, when viewed in a rotation axis line direction of the facing member, a conveyance direction of the transfer material at the secondary transfer portion is a direction crossing a line that connects a rotation center of the secondary transfer member and a rotation center of the facing member, and an attaching/detaching direction of the transfer unit is a direction intersecting with a surface of the transfer material to which the toner image is transferred at the secondary transfer portion, wherein, when viewed in the rotation axis line direction of the facing member, the transfer unit includes an abutting portion which is arranged so that the abutting portion at least partially overlaps the facing member, wherein the positioning unit includes a first abutting face which abuts on the abutting portion to position the transfer unit in the conveyance direction and a second abutting face which abuts on the abutting portion to position the transfer unit in a direction opposite to the conveyance direction in a state where the transfer unit receives urging force from the urging member via the secondary transfer member, wherein, when viewed in the rotation axis line direction of the facing member, the second abutting face is arranged on an upstream side of the first abutting face in the conveyance direction, and the first abutting face and the second abutting face are faces extending in a direction intersecting with the conveyance direction, and wherein the first and the second abutting faces are arranged so that a space between the first and the second abutting faces is increased toward the upstream side in an attaching direction of the transfer unit.

2. The image forming apparatus according to claim 1, wherein the positioning unit further includes an inclination portion for guiding the transfer unit to a lower side in a gravitational direction, and wherein, when viewed in the rotation axis line direction of the facing member, the inclination portion is arranged on the upstream side of the first abutting face and the second abutting face in the attaching direction of the transfer unit.

3. The image forming apparatus according to claim 1, wherein the facing member is a driving roller for rotationally driving the endless belt.

4. The image forming apparatus according to claim 3, wherein the abutting portion is a boss, and wherein the boss is arranged on a rotation shaft of the driving roller and is projected toward a side opposite to a side where the endless belt is arranged on a frame of the transfer unit in the rotation axis line direction of the driving roller.

5. The image forming apparatus according to claim 1, further comprising an opening-closing unit configured to open an inner portion of the image forming apparatus, wherein the secondary transfer portion can be retreated from a position where the secondary transfer portion abuts on the endless belt to a position where the secondary transfer portion is separated from the endless belt in conjunction with opening movement of the opening-closing unit, and the transfer unit can be attached or detached in the direction intersecting with the surface of the transfer material to which the toner image is transferred at the secondary transfer portion when the secondary transfer portion is retreated.

6. The image forming apparatus according to claim 1, further comprising a guiding member configured to guide the transfer unit when the transfer unit is attached or detached, wherein the transfer unit includes a boss which is configured to be guided by the guiding member and is arranged downstream of the abutting portion in the attaching direction of the transfer unit.

7. The image forming apparatus according to claim 6, wherein the guiding member includes a rail groove for guiding the boss, and wherein the boss is arranged on a rotation shaft of a stretching member arranged on a most downstream side in the attaching direction of the transfer unit from among the plurality of stretching members and is projected to a side opposite to a side where the endless belt is arranged on a frame of the transfer unit.

8. The image forming apparatus according to claim 1, wherein the transfer unit includes a separation unit configured to separate the image bearing member and the endless belt by moving the primary transfer member in a direction away from the image bearing member, wherein the separation unit can separate the secondary transfer member and the endless belt by moving the secondary transfer member against the urging force of the urging member, wherein, in a state where the secondary transfer member abuts on the endless belt, the transfer unit is positioned with respect to the positioning unit by receiving the urging force of the urging member via the secondary transfer member, and wherein, in a state where the secondary transfer member is separated from the endless belt, the transfer unit is positioned with respect to the positioning unit by receiving the urging force of the urging member via the separation unit.

9. The image forming apparatus according to claim 1, wherein the transfer unit includes a holding portion configured to be held by a user when attachment/detachment work is executed, and wherein, in the rotation axis line direction of the facing member, a position where the holding portion is arranged and a position where the positioning unit is arranged at least partially overlap with each other.

* * * * *